US011258214B2

(12) United States Patent
Janowiak et al.

(10) Patent No.: US 11,258,214 B2
(45) Date of Patent: Feb. 22, 2022

(54) COMPACT HIGH SPEED CONNECTOR

(71) Applicant: Molex, LLC, Lisle, IL (US)

(72) Inventors: Brandon Janowiak, Wheaton, IL (US); Kent E. Regnier, Lombard, IL (US); Jerry Kachlic, Glen Ellyn, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 17/012,099

(22) Filed: Sep. 4, 2020

(65) Prior Publication Data

US 2020/0403358 A1 Dec. 24, 2020

Related U.S. Application Data

(63) Continuation of application No. 16/429,089, filed on Jun. 3, 2019, now Pat. No. 10,770,845, which is a (Continued)

(51) Int. Cl.
*H01R 24/60* (2011.01)
*H01R 12/72* (2011.01)
(Continued)

(52) U.S. Cl.
CPC ..... *H01R 24/60* (2013.01); *H01R 12/724* (2013.01); *H01R 13/504* (2013.01);
(Continued)

(58) Field of Classification Search
CPC H01R 2107/00; H01R 24/60; H01R 13/6585; H01R 13/6471; H01R 24/62;
(Continued)

(56) References Cited

U.S. PATENT DOCUMENTS 7,175,465 B1 * 2/2007 Tsai ..... H01R 13/6275 439/352
9,022,800 B2 * 5/2015 Yang ..... H05K 7/2039 439/487
(Continued)

FOREIGN PATENT DOCUMENTS

JP H09-232039 A 9/1997
JP H10-125406 A 5/1998
(Continued)

OTHER PUBLICATIONS

International Search Report and Written Opinion received for PCT application No. PCT/US2016/000110, dated Mar. 6, 2017, 9 pages.
(Continued)

*Primary Examiner* — Edwin A. Leon
*Assistant Examiner* — Matthew T Dzierzynski

(57) ABSTRACT

A connector system includes a plug assembly that has a front connector mounted to a circuit board. The connecter has two wafers that each support a row of terminals and uses shims and pegs to precisely control the spatial relationship of the two wafers to the circuit board. The wafers need not be directly contacting the circuit board and the terminals can have tails that can be positioned slightly above the circuit board and connector to pads on the circuit board via solder connections. The connector system is optimized so as to enable support of 25 Gbps data rates.

15 Claims, 42 Drawing Sheets

Related U.S. Application Data continuation of application No. 15/550,459, filed as application No. PCT/US2016/000110 on Nov. 7, 2016, now Pat. No. 10,312,645.

(60) Provisional application No. 62/306,922, filed on Mar. 11, 2016, provisional application No. 62/252,156, filed on Nov. 6, 2015.

(51) Int. Cl.

| | |
|---|---|
| ***H01R 13/504*** | (2006.01) |
| ***H01R 13/6594*** | (2011.01) |
| ***H01R 13/629*** | (2006.01) |
| ***H01R 13/639*** | (2006.01) |
| ***H01R 13/6582*** | (2011.01) |
| ***H01R 107/00*** | (2006.01) |

(52) U.S. Cl.
CPC ..... *H01R 13/629* (2013.01); *H01R 13/639* (2013.01); *H01R 13/6582* (2013.01); *H01R 13/6594* (2013.01); *H01R 2107/00* (2013.01)

(58) Field of Classification Search
CPC ..... H01R 13/6582; H01R 12/724; H01R 13/6275; H01R 13/6594; H01R 13/6581; H01R 13/6273; H01R 13/6658; H01R 12/7076; H01R 13/6272; H01R 13/6473; H01R 24/64; H01R 13/405; H01R 12/716; H01R 13/6593; H01R 12/707
See application file for complete search history.

(56) References Cited

U.S. PATENT DOCUMENTS

| | | | | |
|---|---|---|---|---|
| 9,214,767 | B1 * | 12/2015 | Yu | H01R 13/6585 |
| 9,281,626 | B2 * | 3/2016 | Lin | H01R 13/6581 |
| 9,306,345 | B2 * | 4/2016 | Hsu | H01R 13/6582 |
| 9,337,585 | B1 * | 5/2016 | Yang | H01R 13/6471 |
| 9,356,400 | B2 * | 5/2016 | Little | H01R 4/023 |
| 9,385,488 | B2 * | 7/2016 | Qi | H01R 12/721 |
| 9,397,442 | B2 * | 7/2016 | Sutter | H01R 13/6275 |
| 9,450,337 | B2 * | 9/2016 | Kao | H01R 13/6461 |
| 9,461,425 | B2 * | 10/2016 | Tamaki | H01R 13/508 |
| 9,478,884 | B2 * | 10/2016 | Tsai | H01R 12/724 |
| 9,490,594 | B2 * | 11/2016 | Little | H01R 13/6658 |
| 9,502,827 | B2 * | 11/2016 | Feng | H01R 13/6581 |
| 9,590,360 | B2 * | 3/2017 | Chuang | H01R 13/627 |
| 9,620,904 | B2 * | 4/2017 | Kao | H01R 13/6582 |
| 9,793,662 | B2 * | 10/2017 | Kao | H01R 24/60 |
| 9,917,405 | B2 * | 3/2018 | Ju | H01R 13/6583 |
| 10,312,645 | B2 * | 6/2019 | Janowiak | H01R 13/639 |
| 10,770,845 | B2 * | 9/2020 | Janowiak | H01R 13/6582 |
| 2008/0176430 | A1 | 7/2008 | Yuan et al. | |
| 2010/0273341 | A1 | 10/2010 | Shen | |
| 2013/0330976 | A1 | 12/2013 | Simmel et al. | |
| 2014/0051290 | A1 | 2/2014 | Kawakami | |
| 2014/0287625 | A1 | 9/2014 | Chan | |
| 2015/0214651 | A1 | 7/2015 | Qi et al. | |
| 2016/0036175 | A1 * | 2/2016 | Yen | H01R 24/60 439/676 |

FOREIGN PATENT DOCUMENTS

| | | | |
|---|---|---|---|
| JP | 2000-058173 | A | 2/2000 |
| JP | 2005-129418 | A | 5/2005 |
| JP | 2010-212017 | A | 9/2010 |
| JP | 2011-086495 | A | 4/2011 |
| JP | 2013522848 | A | 6/2013 |
| JP | 2015-179591 | A | 10/2015 |
| TW | M502992 | U | 6/2015 |
| WO | 2014/113563 | A1 | 7/2014 |
| WO | 2015186495 | A1 | 12/2015 |

OTHER PUBLICATIONS

International Preliminary report on patentability received for PCT application No. PCT/US2016/000110, dated May 17, 2018, 8 pages.
Decision to Grant received for JP patent application No. 2019-040426, dated Mar. 10, 2020, 5 pages.(2 pages of English translation and 3 pages of official copy).
Notice of allowance received for U.S. Appl. No. 15/550,459, dated Jan. 17, 2019, 12 pages.
Office Action received for JP Application No. 2020-068204, dated Apr. 13, 2021, 8 Pages.(4 Pages of English Translation and 4 Pages of Official notification).

* cited by examiner

COMPACT HIGH SPEED CONNECTOR

RELATED APPLICATIONS

This application claims priority to U.S. application Ser. No. 16/429,089, filed Jun. 3, 2019, which in turn claims priority to U.S. application Ser. No. 15/550,459, filed Aug. 11, 2017, which is a national phase of PCT Application No. PCT/US2016/000110, filed on Nov. 7, 2016, which further claims priority to U.S. Provisional Application Ser. No. 62/252,156, filed Nov. 6, 2015 and to U.S. Provisional Application Ser. No. 62/306,922, filed Mar. 11, 2016, all of which are incorporated herein by reference in their entirety.

TECHNICAL FIELD

This disclosure relates to field of input/output ("IO") connectors, more specifically to small IO connectors.

DESCRIPTION OF RELATED ART

IO connectors are commonly used to support network and server applications. Known IO connectors include SFP, QSFP, CXP and XFP style connectors, just to name a few. A new IO connector style is available for use in PCIe standard and is known as an OCULINK connector in the standard. Similar to the QSFP style connector, the OCULINK connector is available 4× connector and thus is expected to be a popular choice for many applications as it provides sufficient bandwidth and front panel density to meet a wide range of applications. Unlike the QSFP style connector, however, the OCULINK connector has terminals on a 0.5 mm pitch and is substantially smaller than a QSFP style connector. An embodiment of the OCULINK connector is described in PCT Publication No. WO2014/113563, which is incorporated herein by reference in its entirety.

Currently OCULINK connectors can support 16 Gbps data rates (and with the 4× design, offers 64 Gbps of bandwidth in both directions) and thus existing OCULINK designs have a performance disadvantage compared to QSFP style connectors that can support 25 Gbps. Given the large difference in size, however, the tradeoff in performance is acceptable for a large number of applications. While the existing connector design is beneficial as is, certain individuals would appreciate improvements to such a connector system that would enable higher data rates.

SUMMARY

A plug connector assembly is disclosed. The plug connector assembly includes a mating portion and a mounting portion and a cover that encloses a connector and a circuit board. The connector includes a shell that wraps around a shell housing. The connector is mated to one end of a circuit board and wires can be terminated to the other end of the circuit board. The connector housing includes a first wafer and a second wafer that each support a row of terminals. The first and second wafer can each have a peg that press against the peg of the other wafer via a cutout in the circuit board so as define a spatial relationship between the first and second wafers. The terminals are connected to the circuit board via solder connection and the first and second wafer are configured to be positioned to be indirectly supported by the circuit board via a shim. The terminals are arranged on a 0.5 mm pitch and in certain embodiments the plug connector is configured to provide a 25 Gbps data rate.

BRIEF DESCRIPTION OF THE DRAWINGS

The present invention is illustrated by way of example and not limited in the accompanying figures in which like reference numerals indicate similar elements and in which.

DETAILED DESCRIPTION OF THE PREFERRED EMBODIMENTS

Figure 1A:
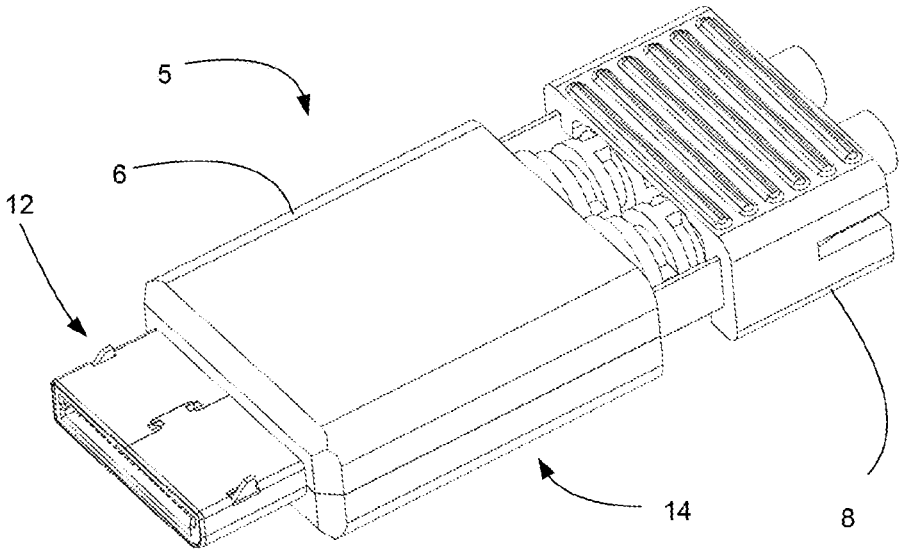
FIG. 1A illustrates a perspective view of an embodiment of a plug connector assembly.
Figure 1B:
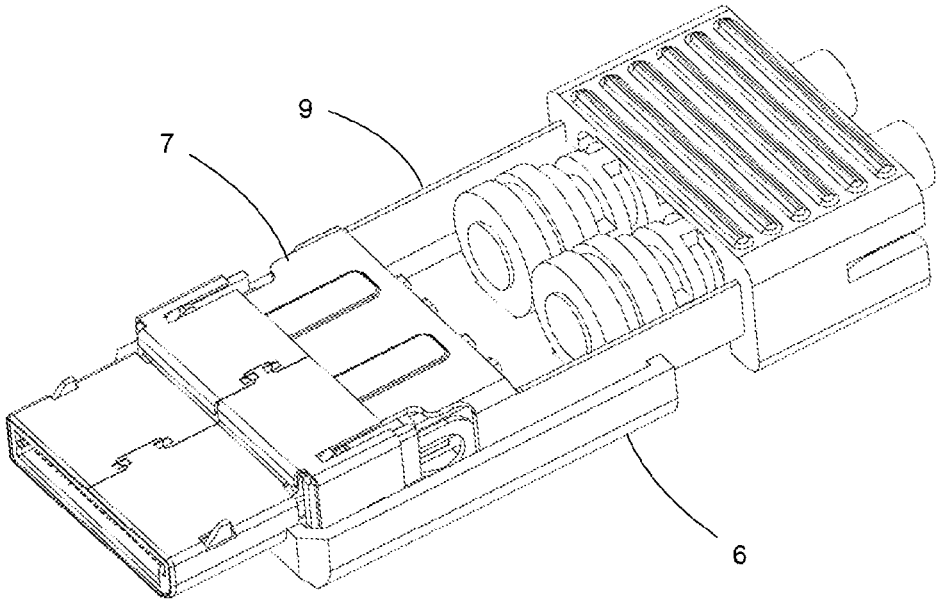
FIG. 1B illustrates a perspective partial view of the plug connector depicted in FIG. 1A.
Figure 2A:
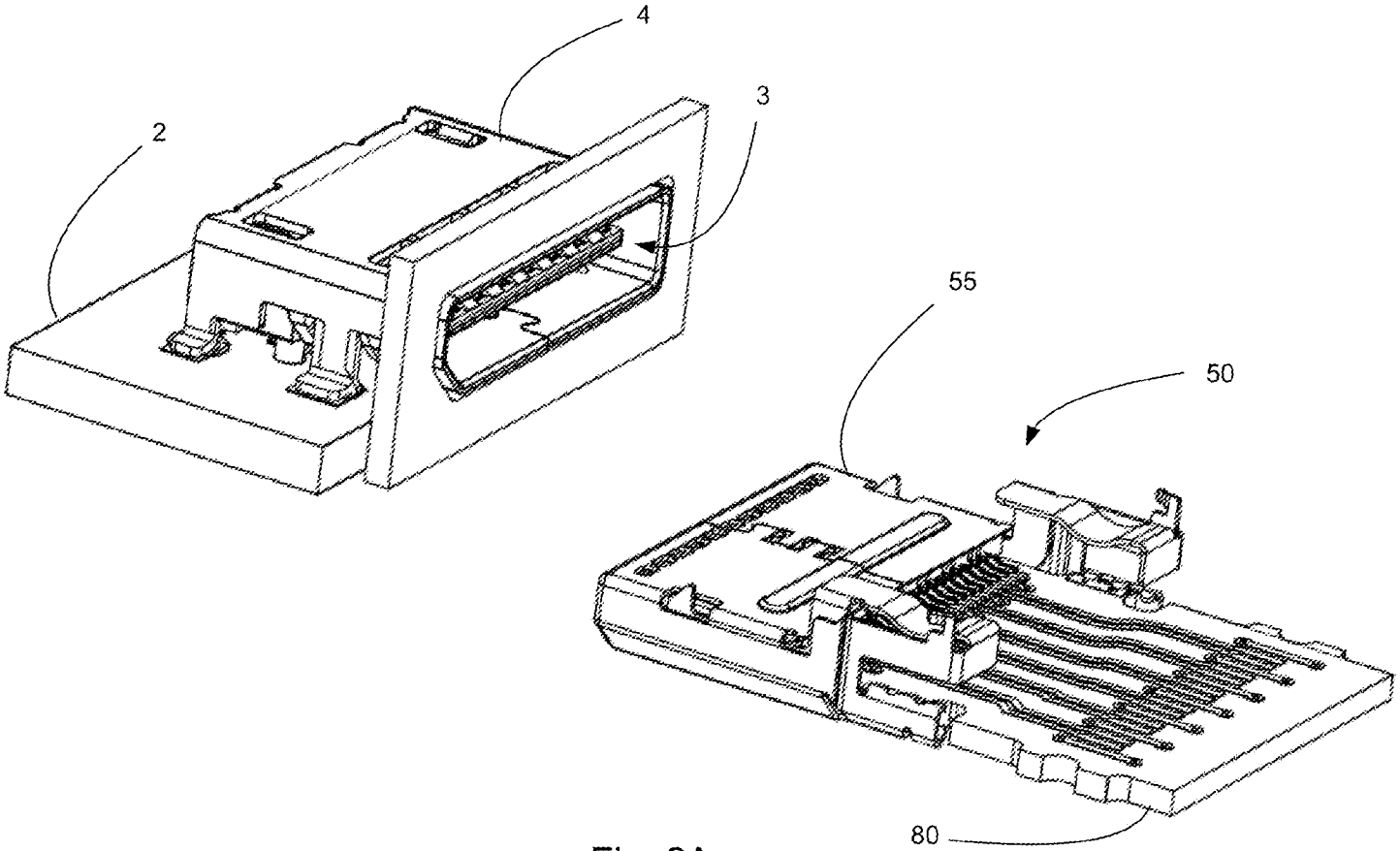
FIG. 2A illustrates a perspective view of a partial plug connector assembly prior to mating with a receptacle connector.
Figure 2B:
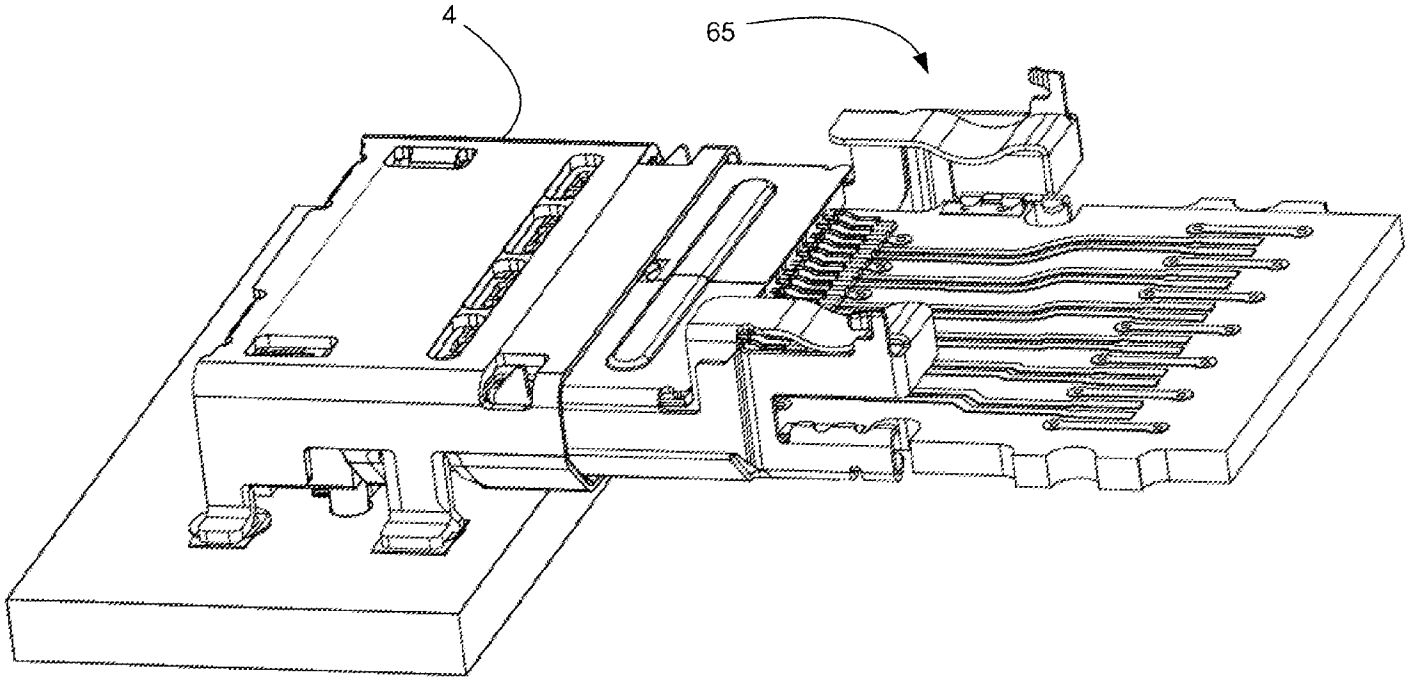
FIG. 2B illustrates a perspective view of the embodiment depicted in FIG. 2A but with the partial plug connector assembly mated to the receptacle connector.
Figure 3:
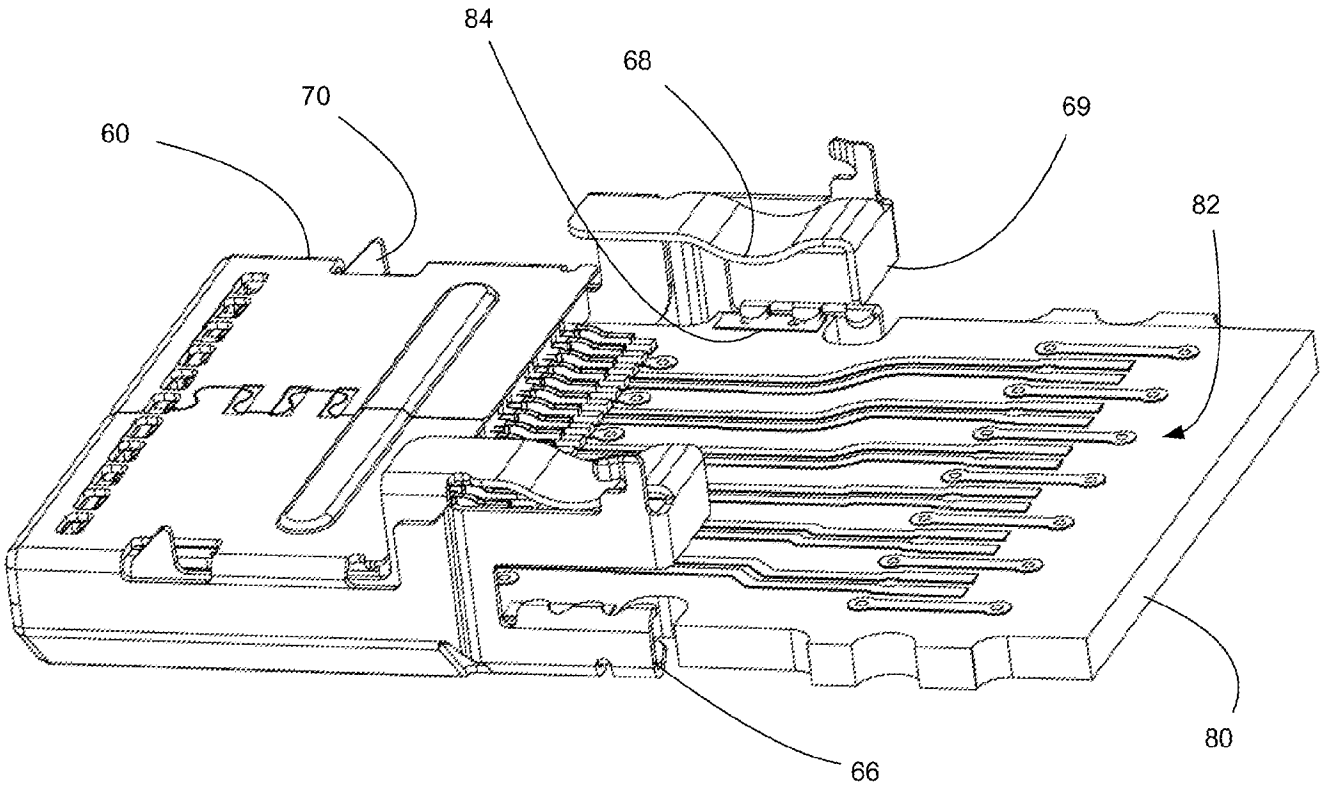
FIG. 3 illustrates a perspective view of an embodiment of a connector positioned on a circuit board.
Figure 4A:
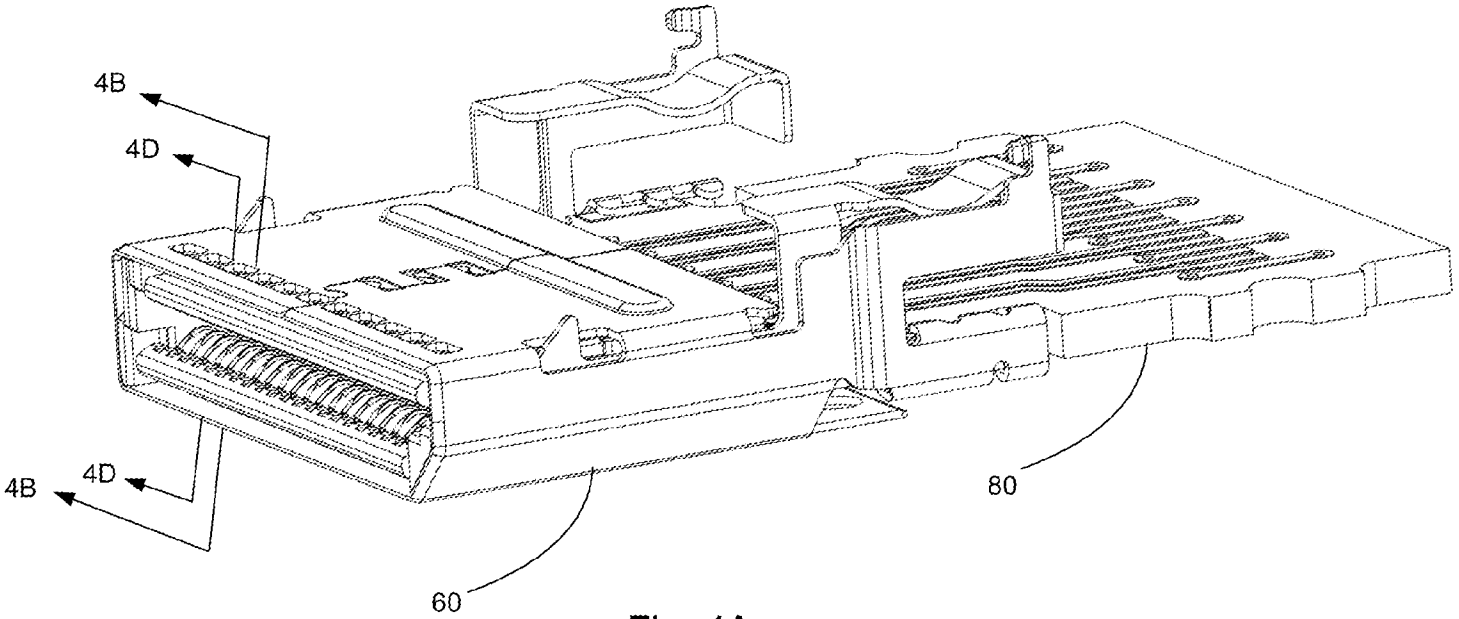
FIG. 4A illustrates another perspective view of the embodiment depicted in FIG. 3.
Figure 4B:
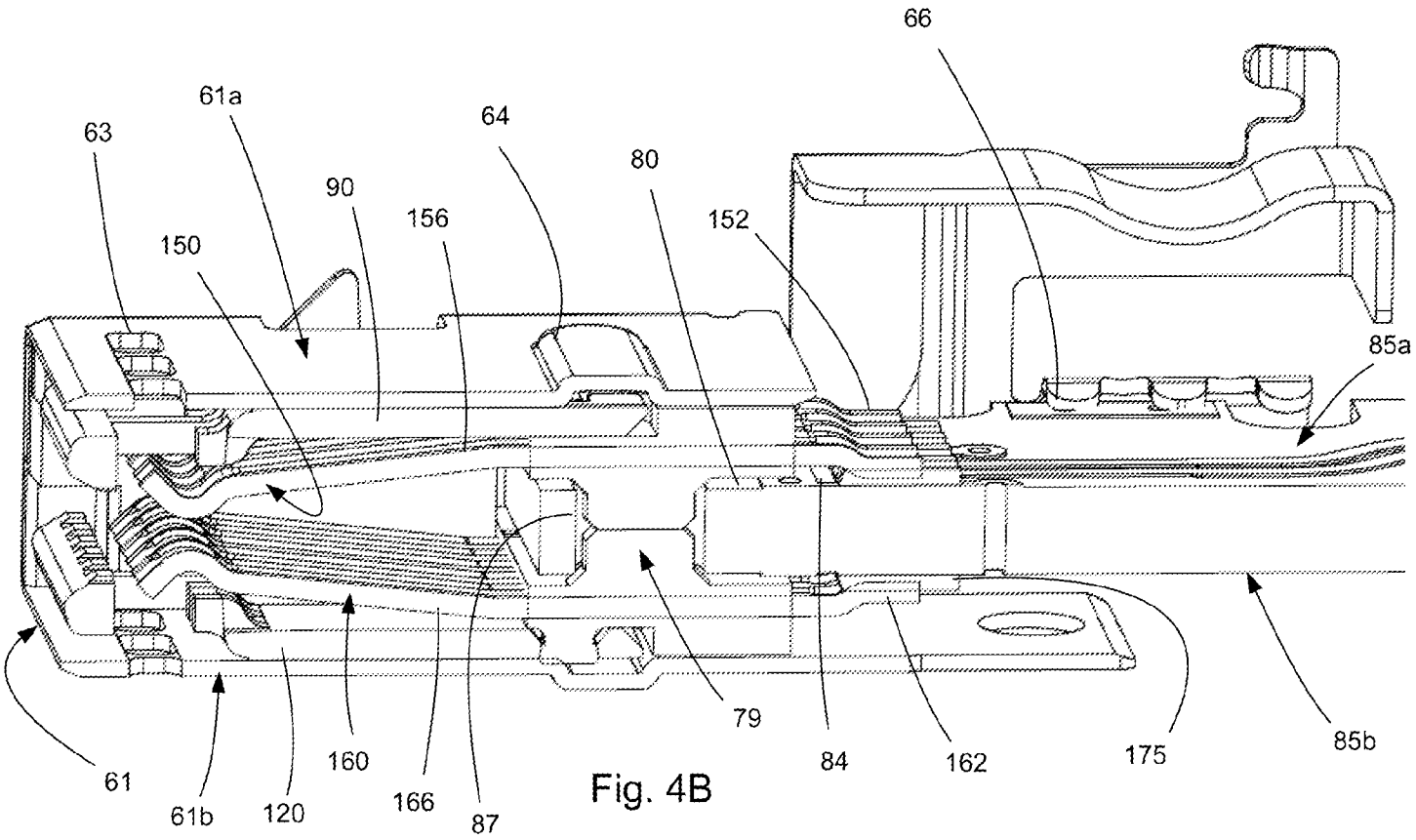
FIG. 4B illustrates a perspective cross-sectional view of the embodiment depicted in FIG. 4A, taken along line 4B-4B.
Figure 4C:
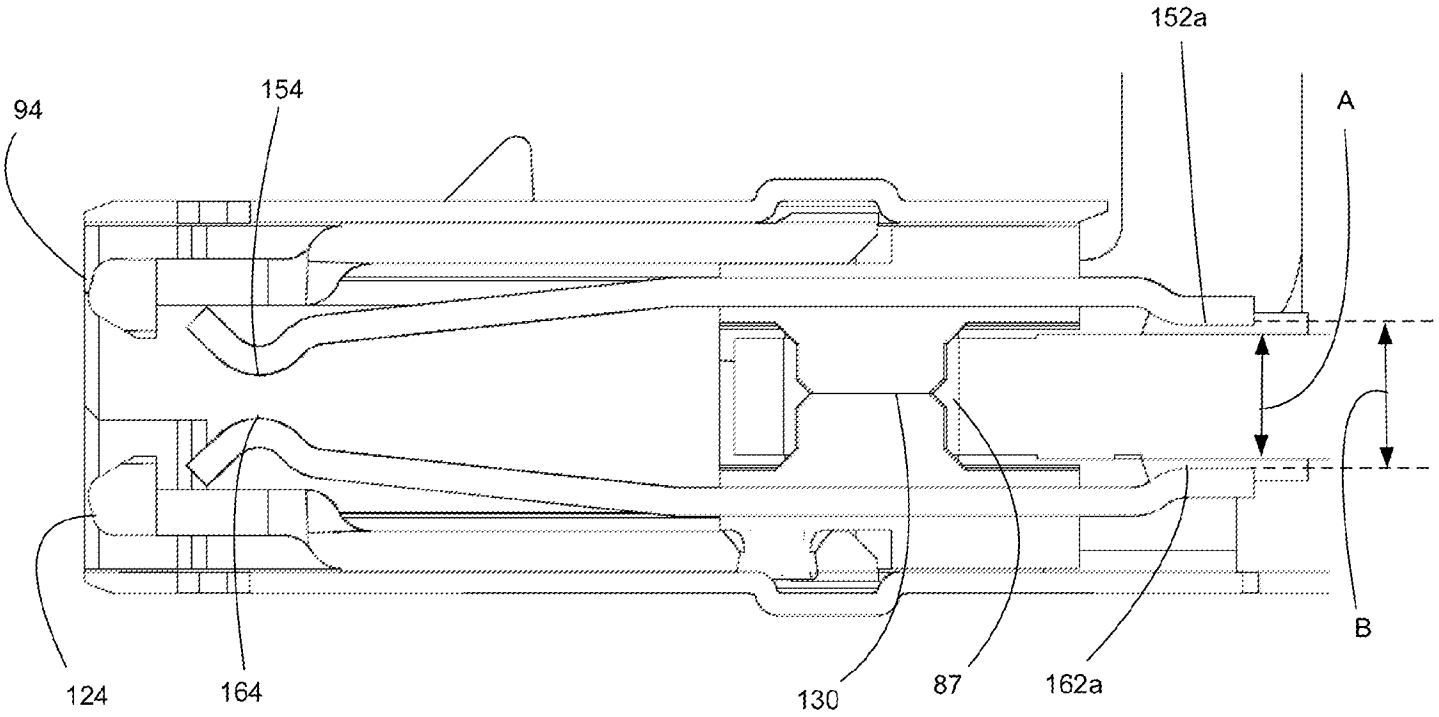
FIG. 4C illustrates an elevated side view of the embodiment depicted in FIG. 4B.
Figure 4D:
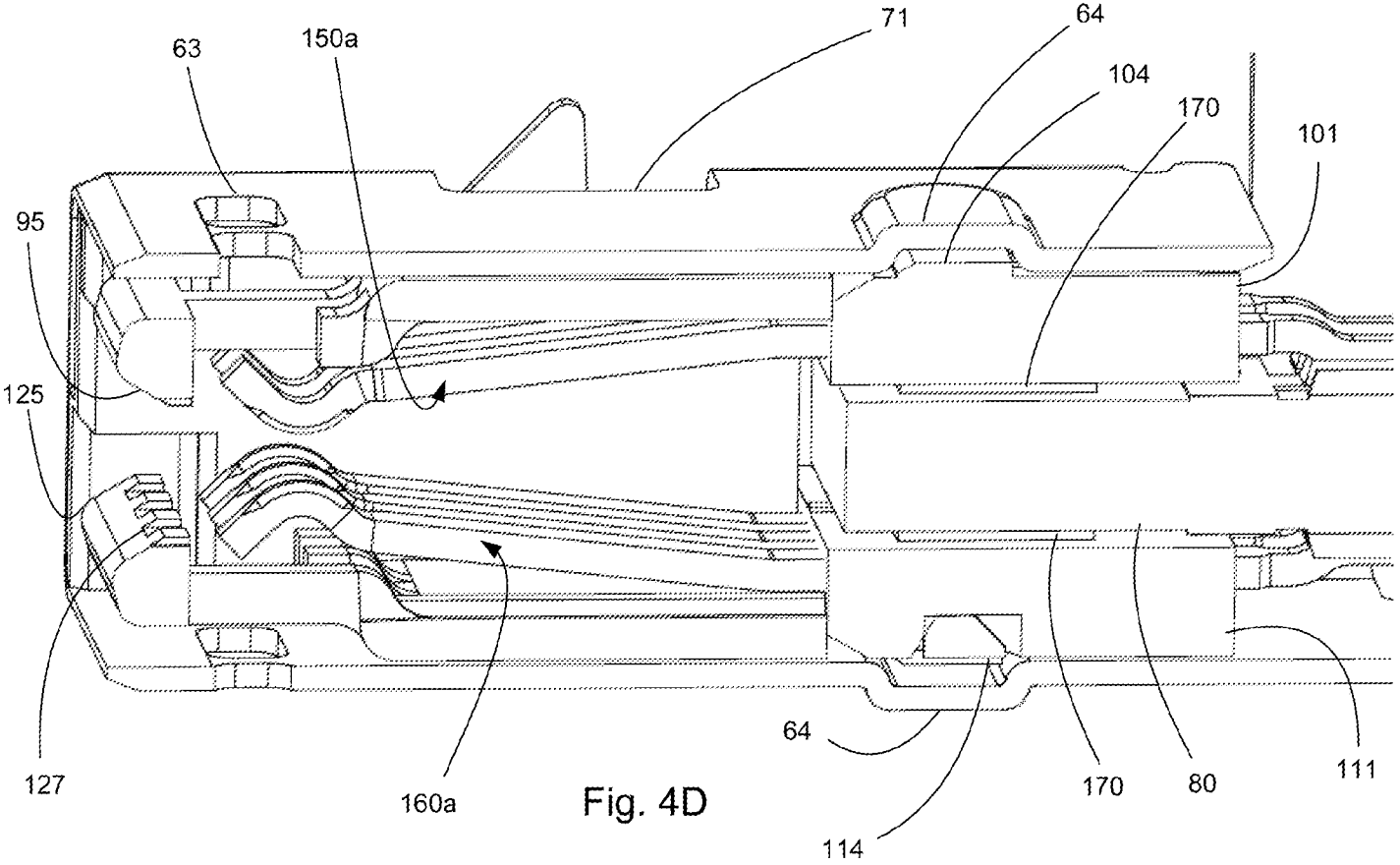
FIG. 4D illustrates a perspective cross-sectional view of the embodiment depicted in FIG. 4A, taken along line 4D-4D.
Figure 4E:
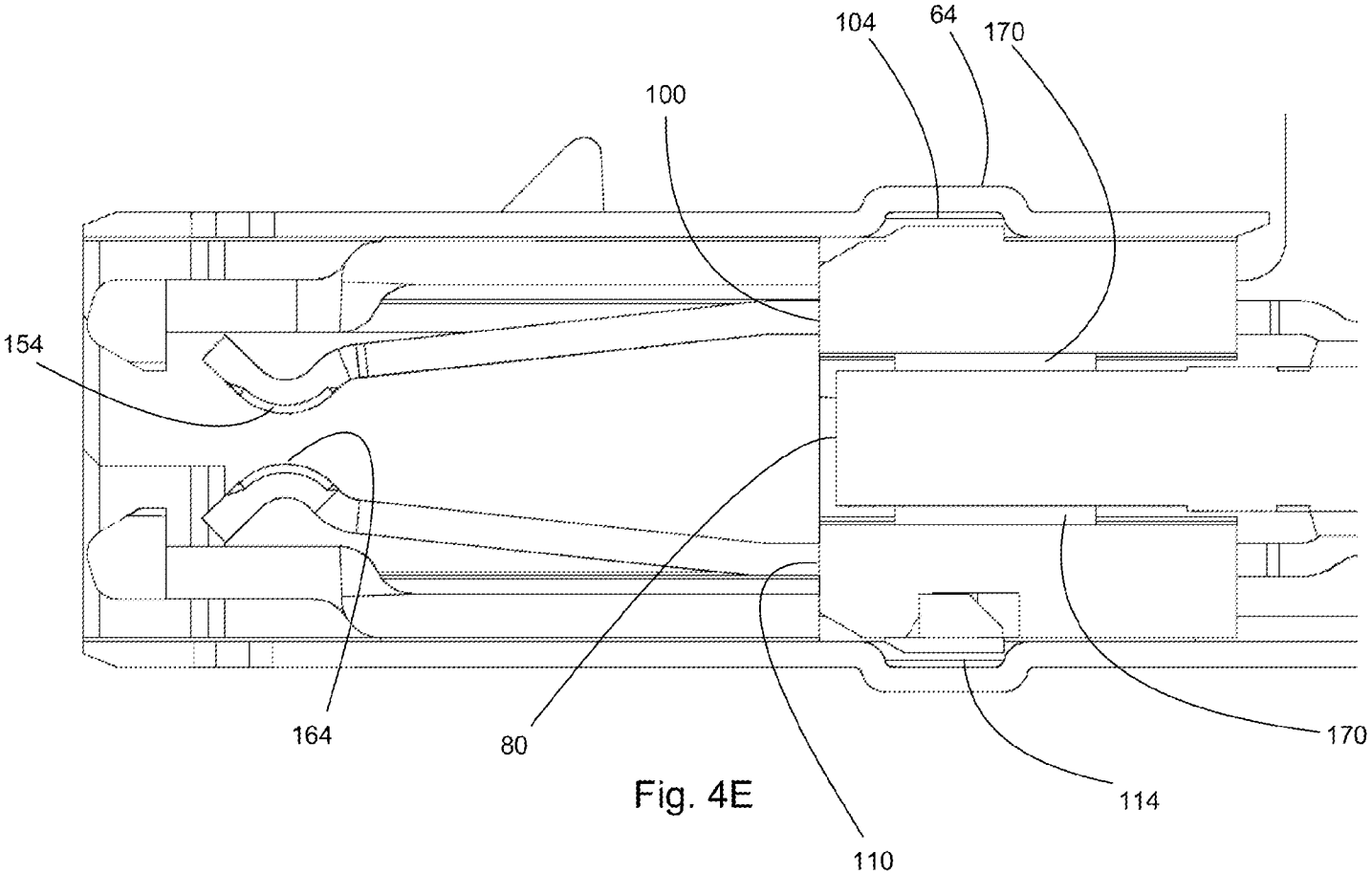
FIG. 4E illustrates an elevated side view of the embodiment depicted in FIG. 4D.
Figure 5:
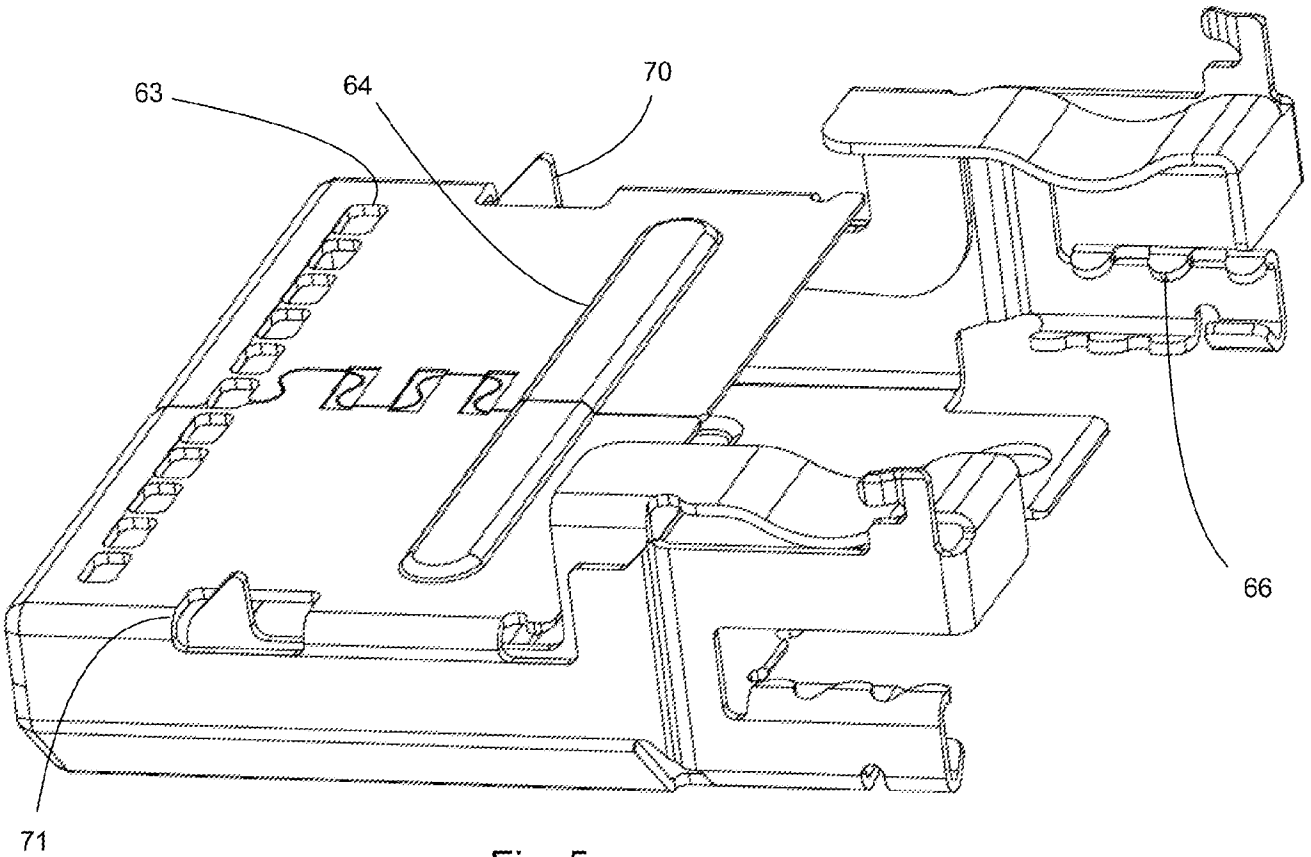
FIG. 5 illustrates a perspective view of an embodiment of a shell.
Figure 6:
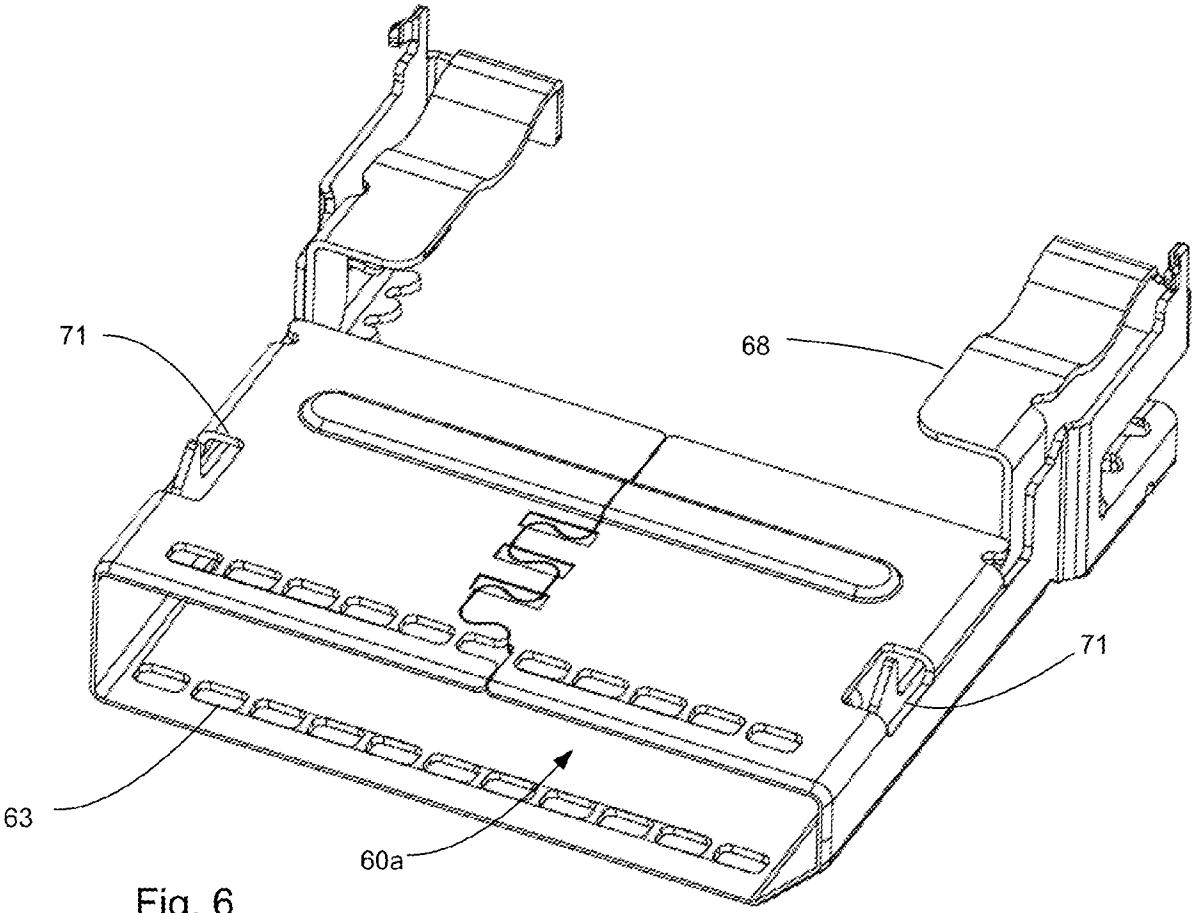
FIG. 6 illustrates another perspective view of the shell depicted in FIG. 5.
Figure 7:
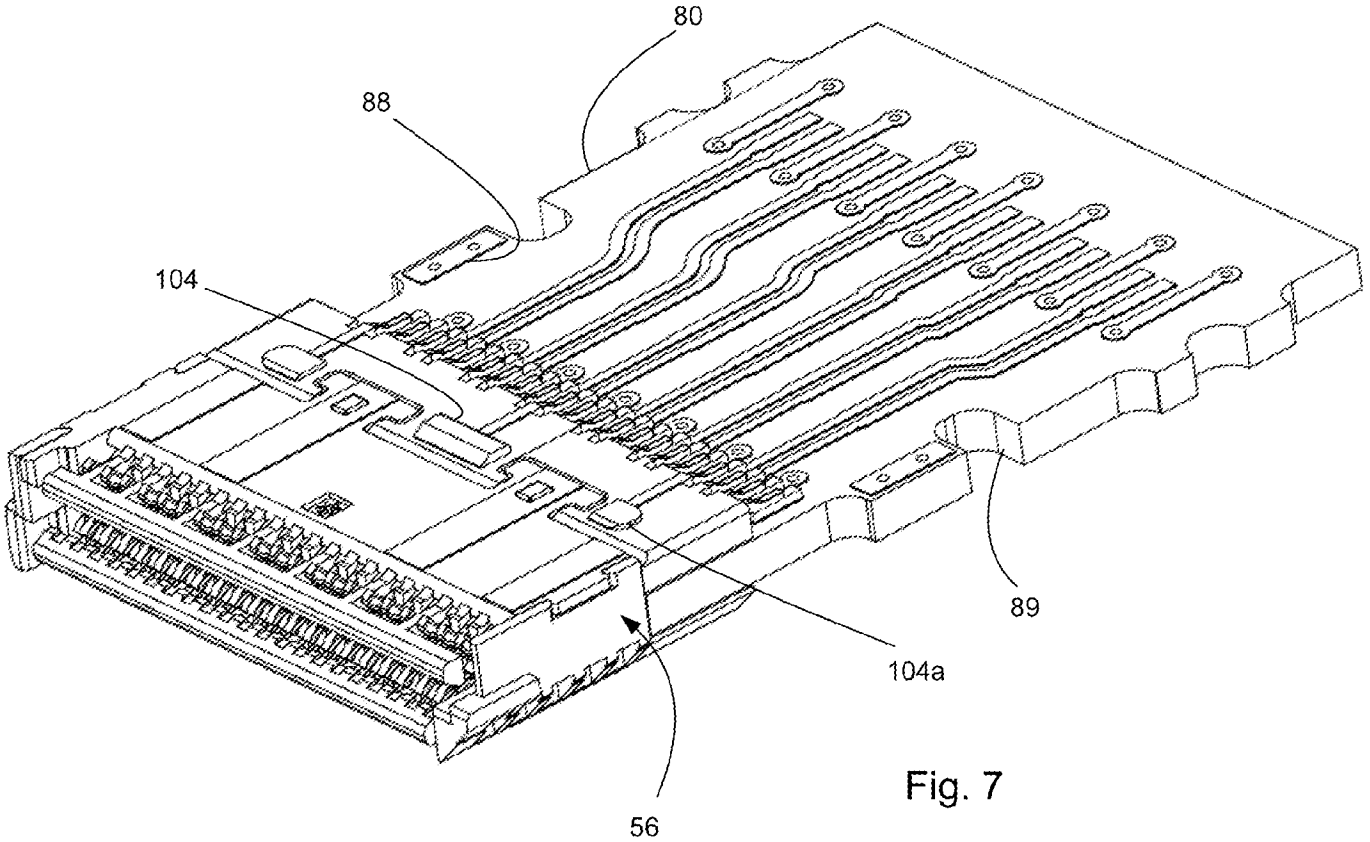
FIG. 7 illustrates a perspective view of a partial connector mounted on a circuit board but with the shell removed for purposes of illustration.
Figure 8:
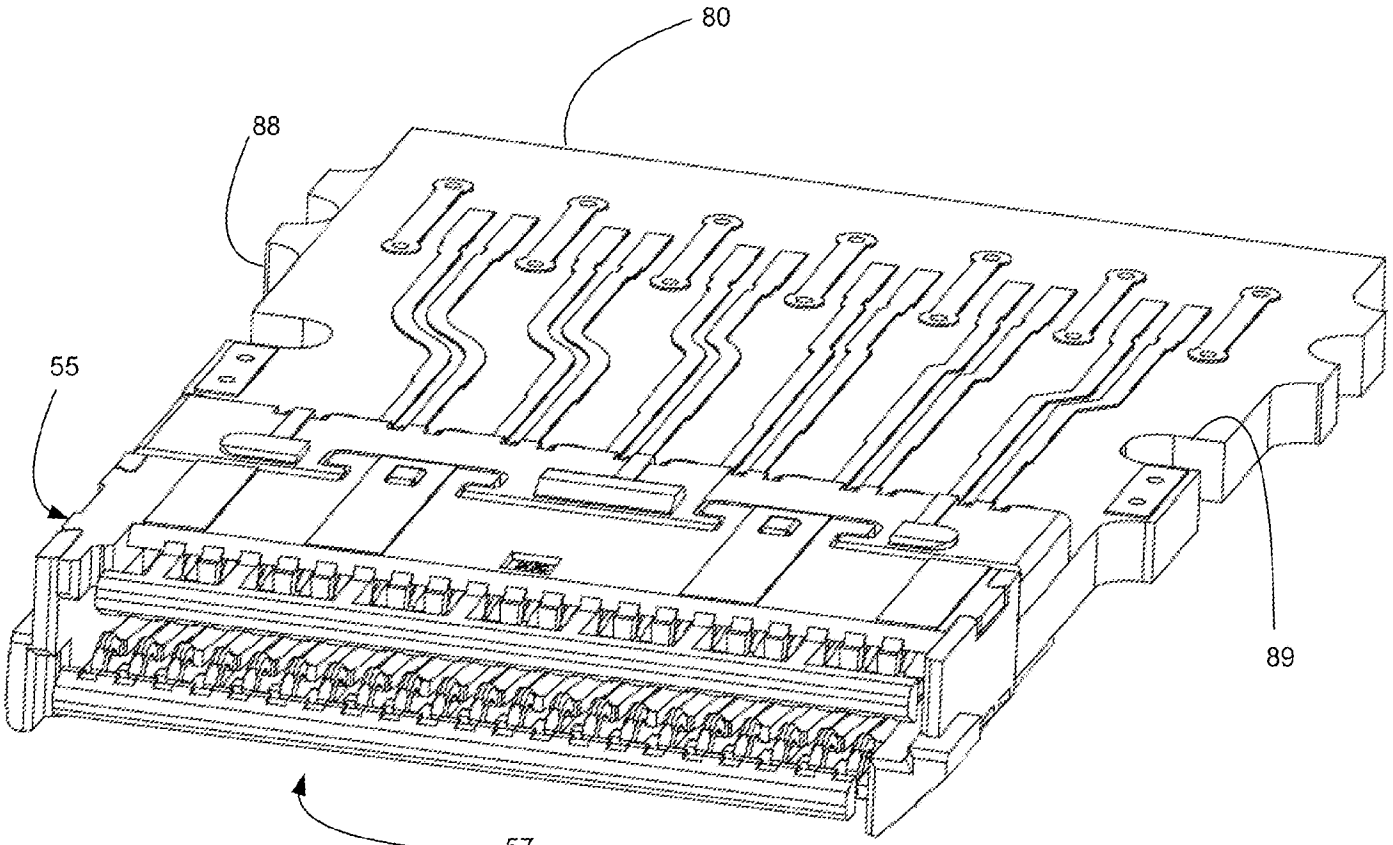
FIG. 8 illustrates another perspective view of the embodiment depicted in FIG. 7.
Figure 9:
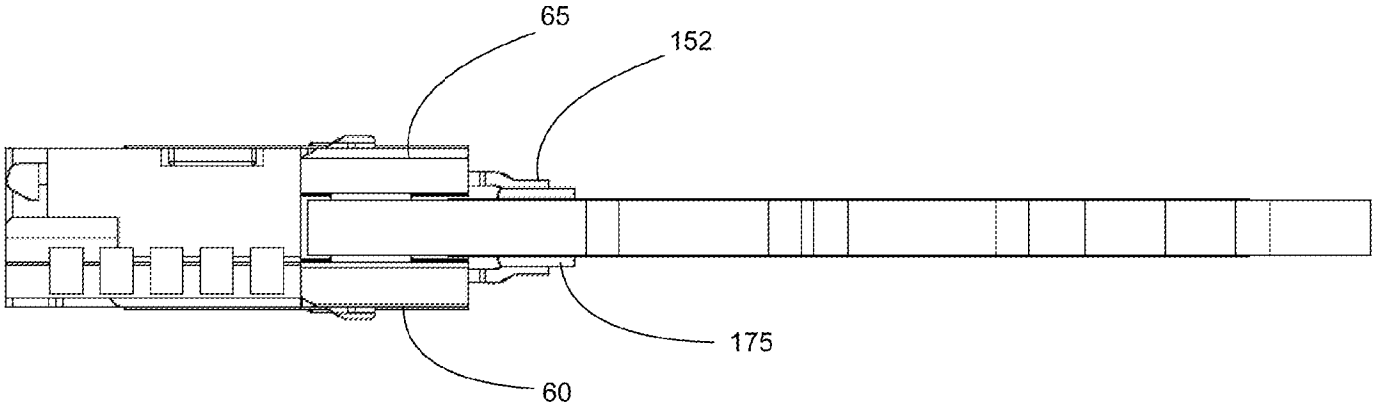
FIG. 9 illustrates an elevated side view of the embodiment depicted in FIG. 7.
Figure 10:
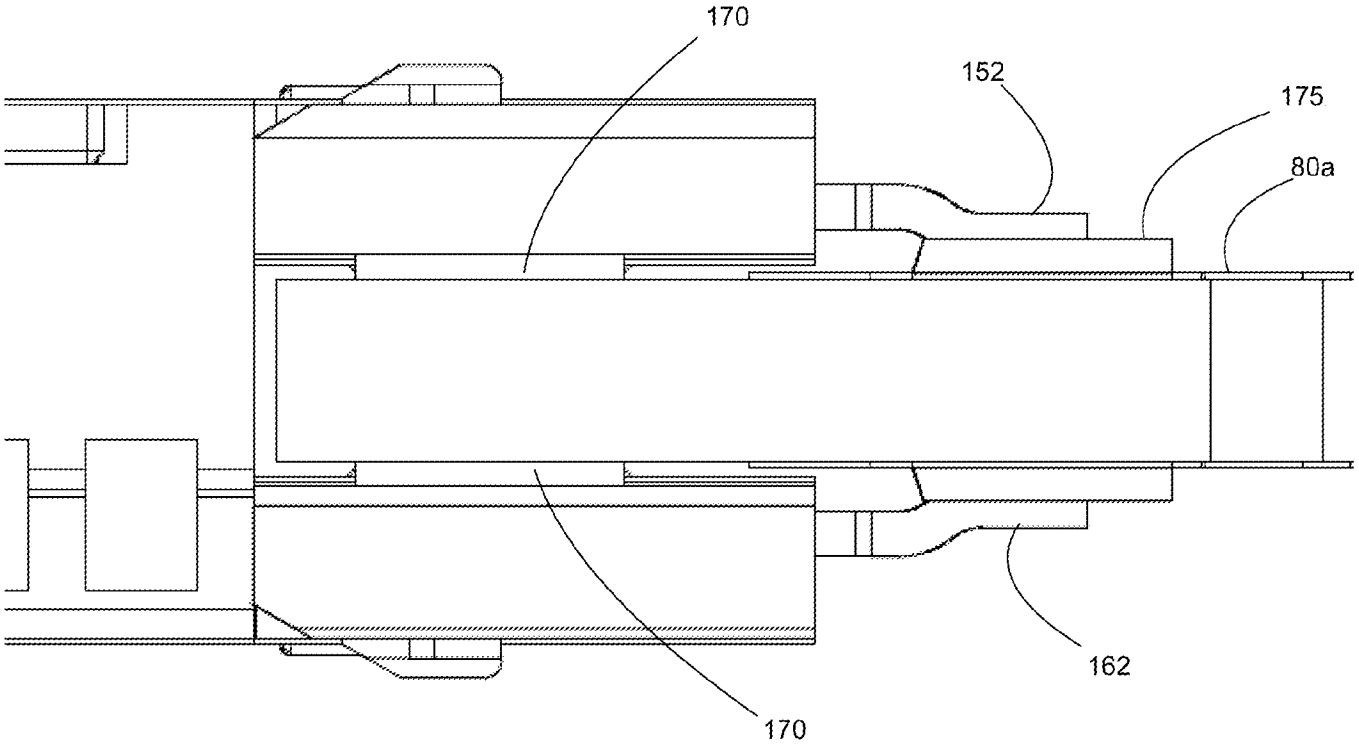
FIG. 10 illustrates an enlarged view of the embodiment depicted in FIG. 9.
Figure 11:
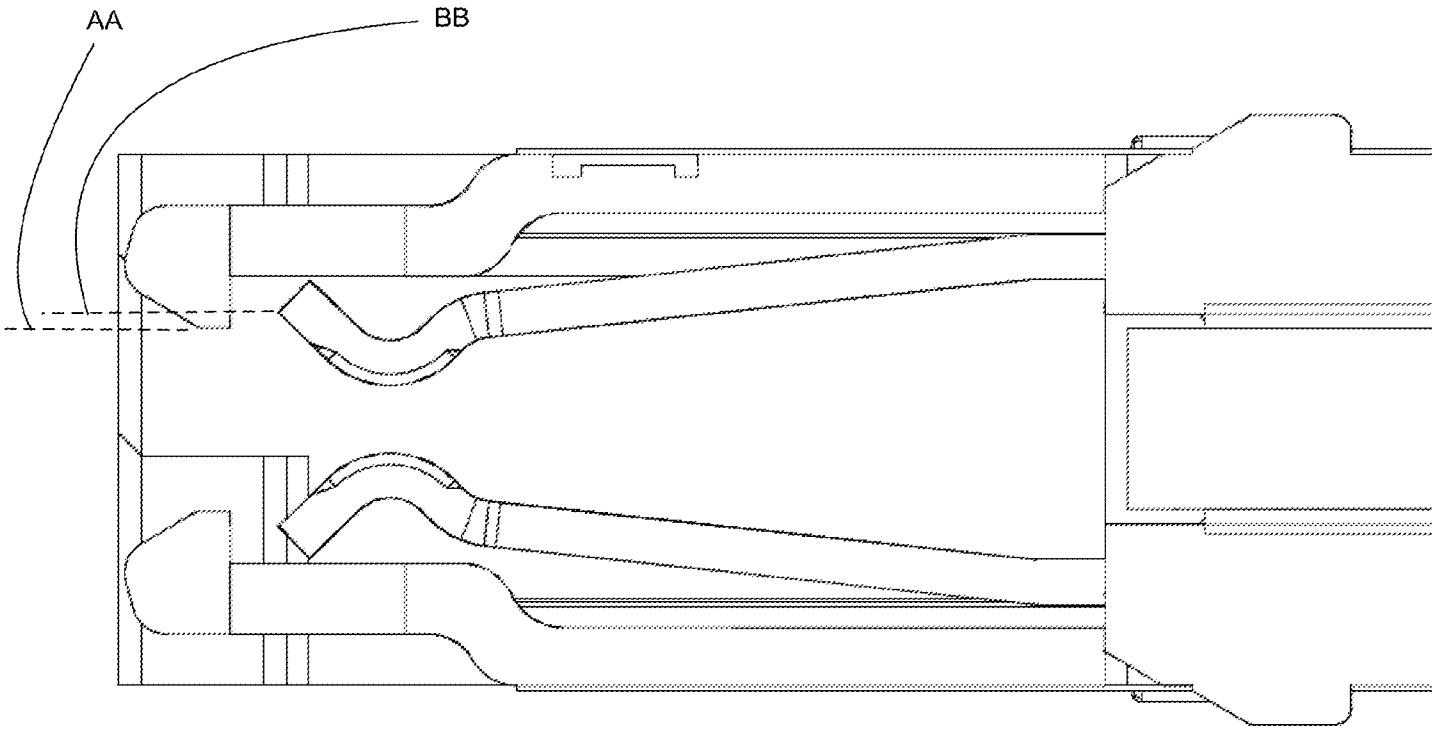
FIG. 11 illustrates an enlarged view of the embodiment depicted in FIG. 5E.
Figure 12:
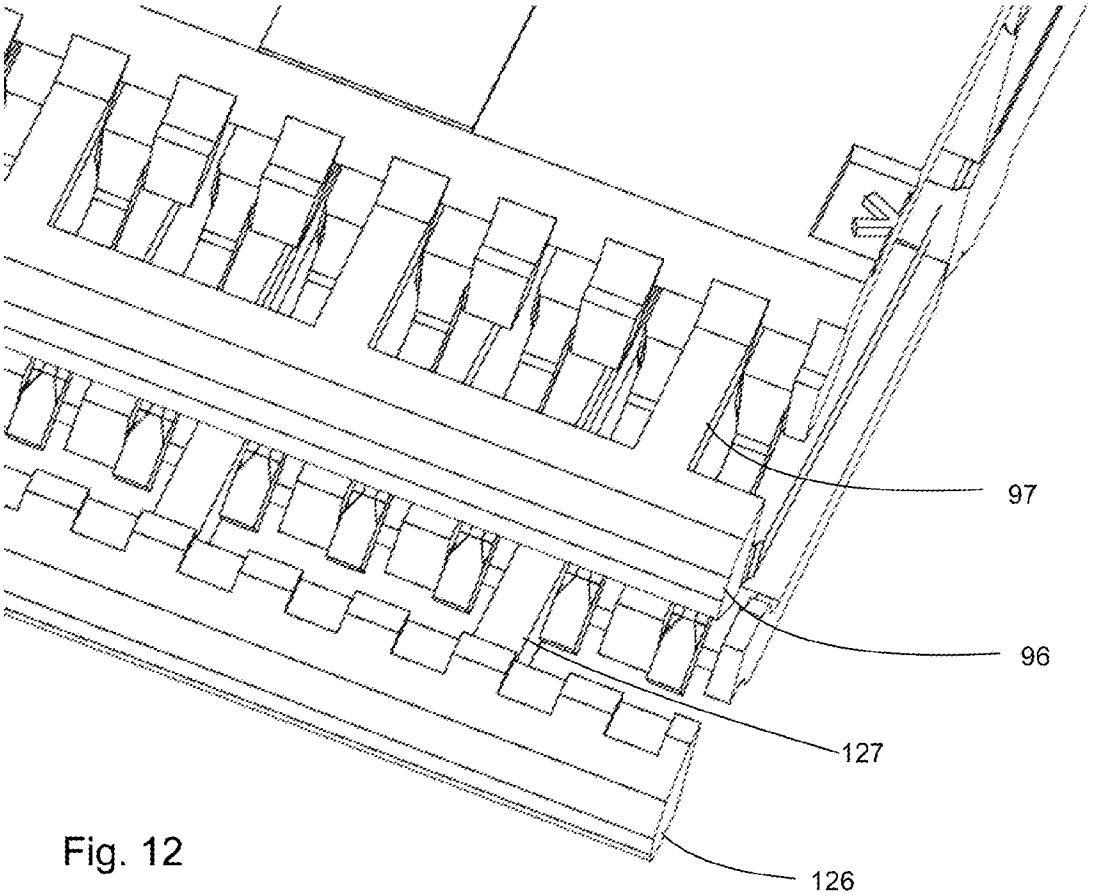
FIG. 12 illustrates a perspective view of the embodiment depicted in FIG. 11.
Figure 13:
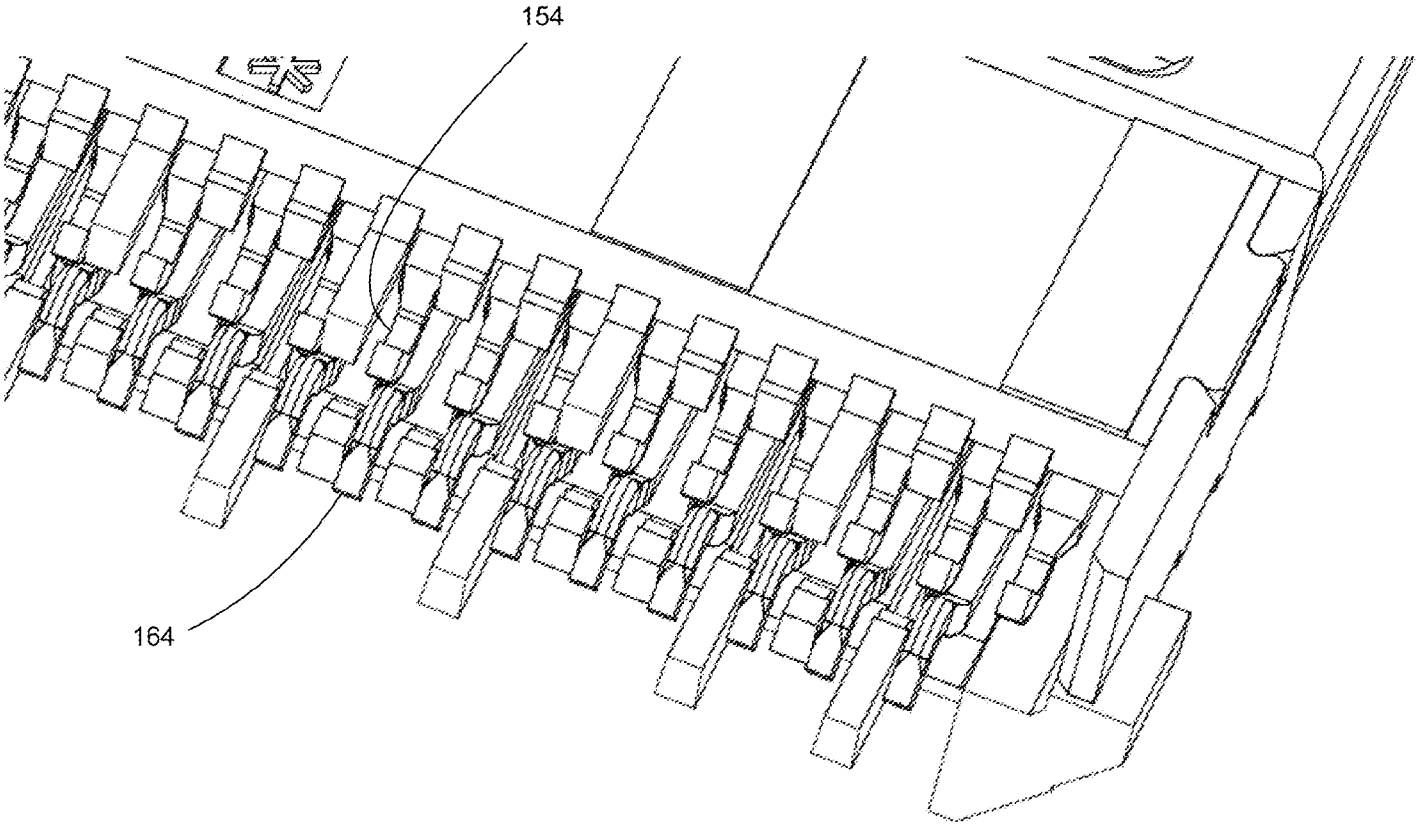
FIG. 13 illustrates a partial simplified perspective view of the embodiment depicted in FIG. 12.
Figure 14A:
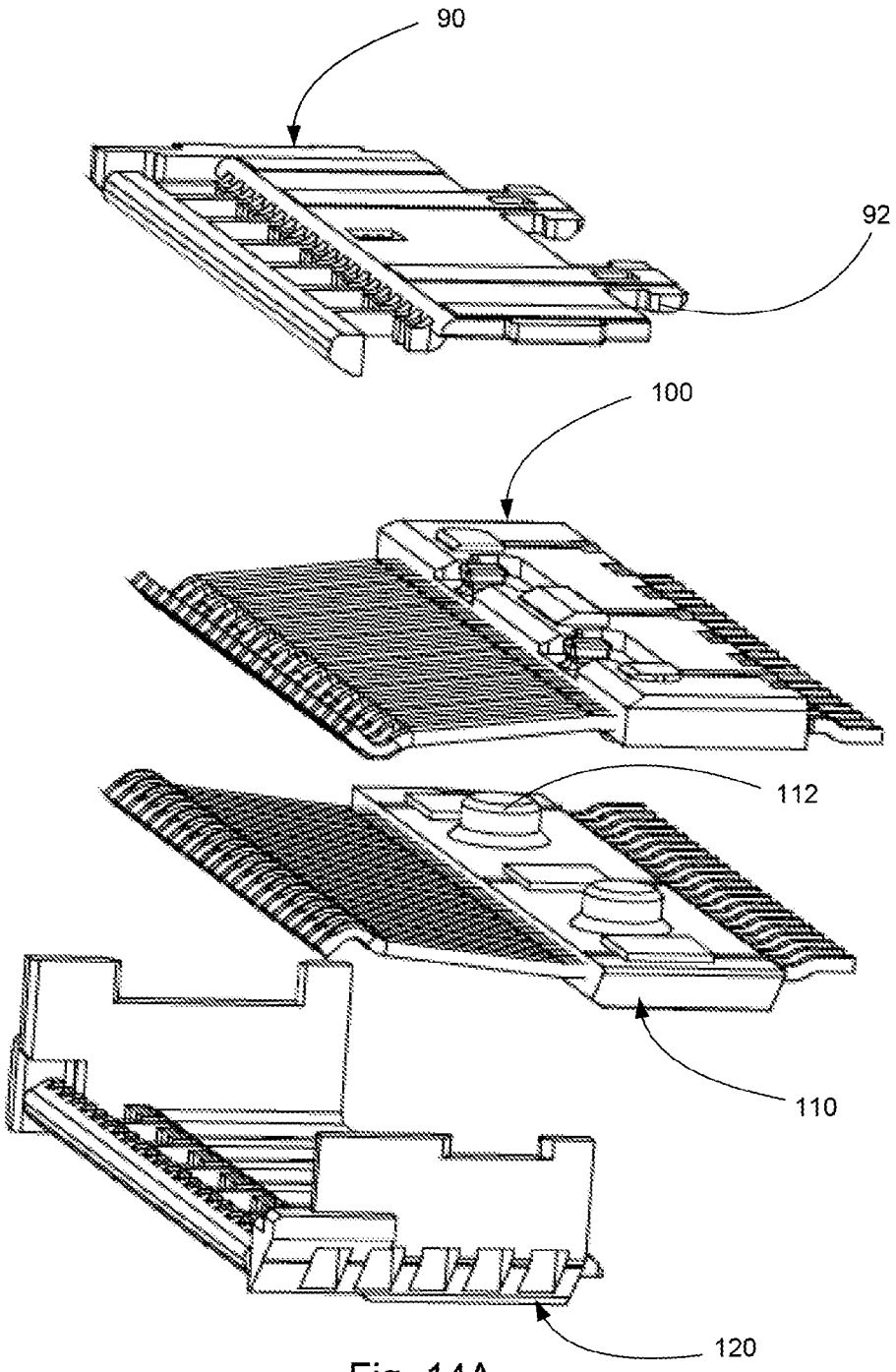
FIG. 14A illustrates a perspective exploded view of an embodiment of a housing shell and wafers that can be used to provide a connector.
Figure 14B:
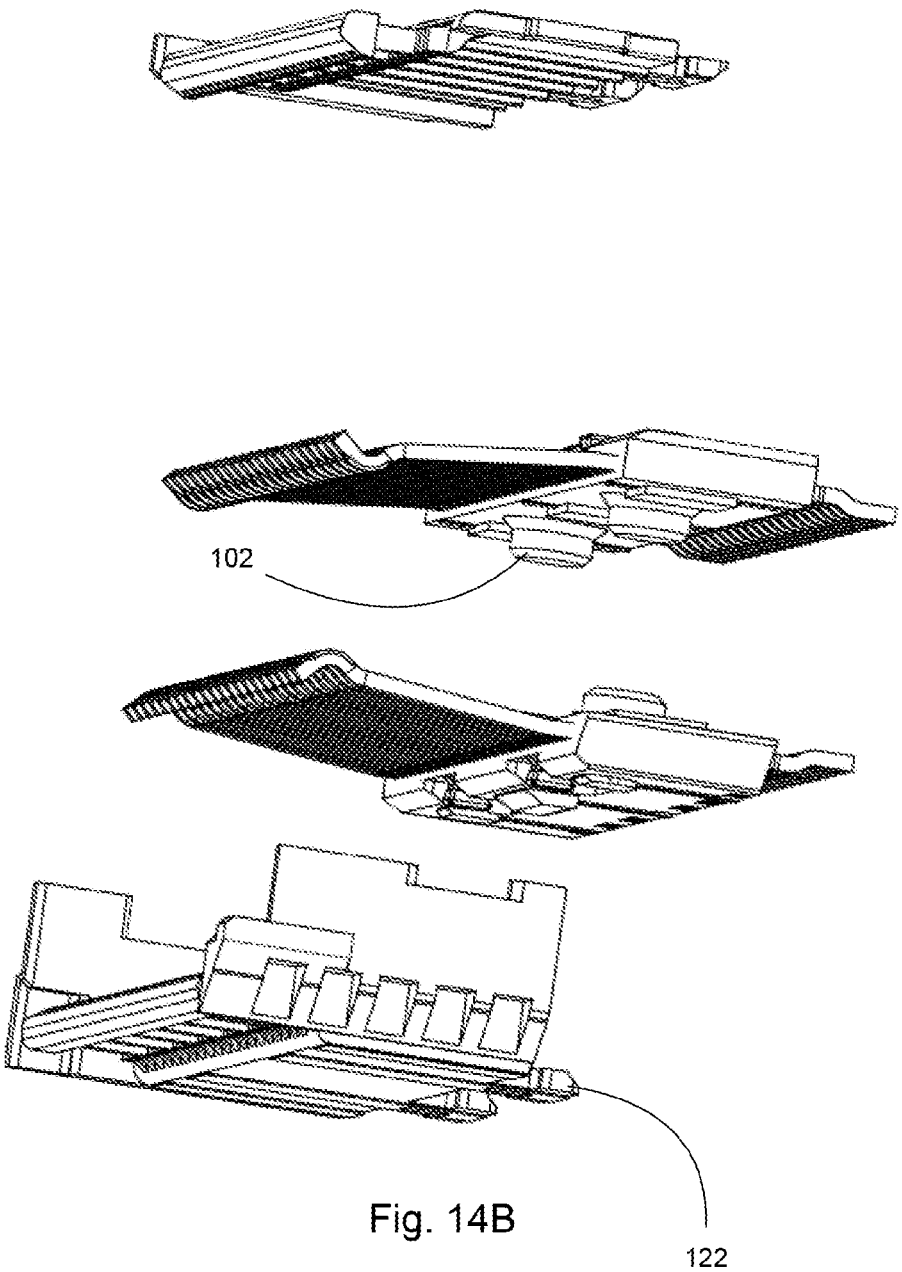
FIG. 14B illustrates another perspective view of the embodiment depicted in FIG. 14A.
Figure 14C:
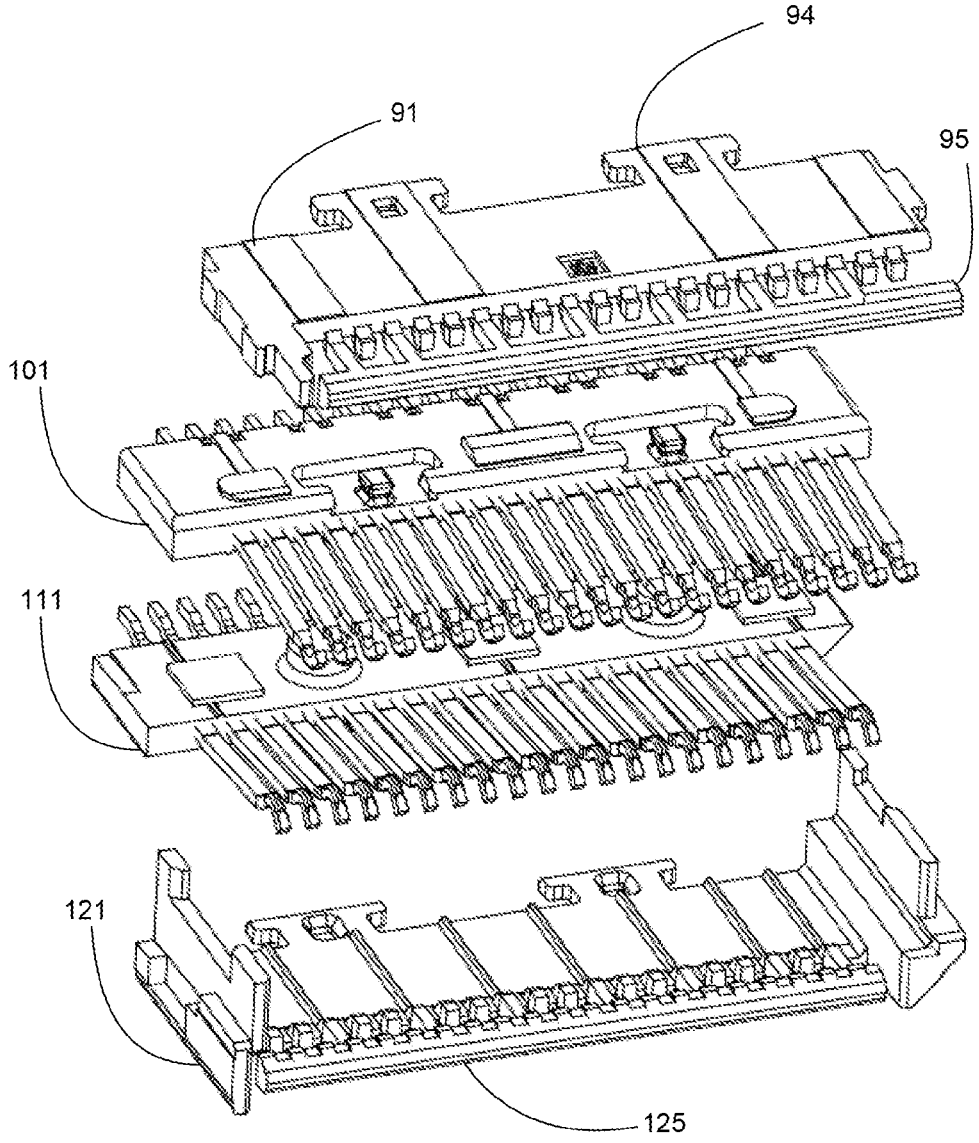
FIG. 14C illustrates another perspective view of the embodiment depicted in FIG. 14A.
Figure 15A:
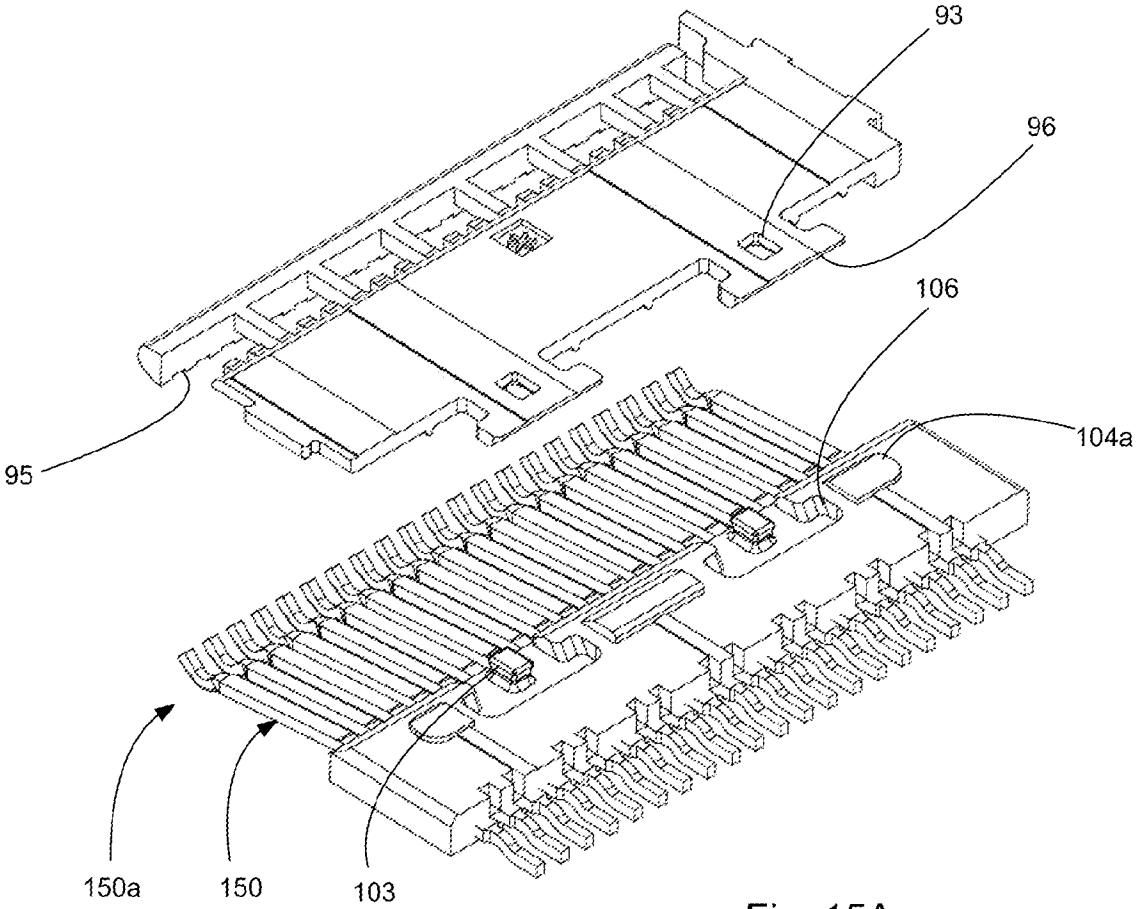
FIG. 15A illustrates a perspective exploded view of a half shell and a wafer.
Figure 15B:
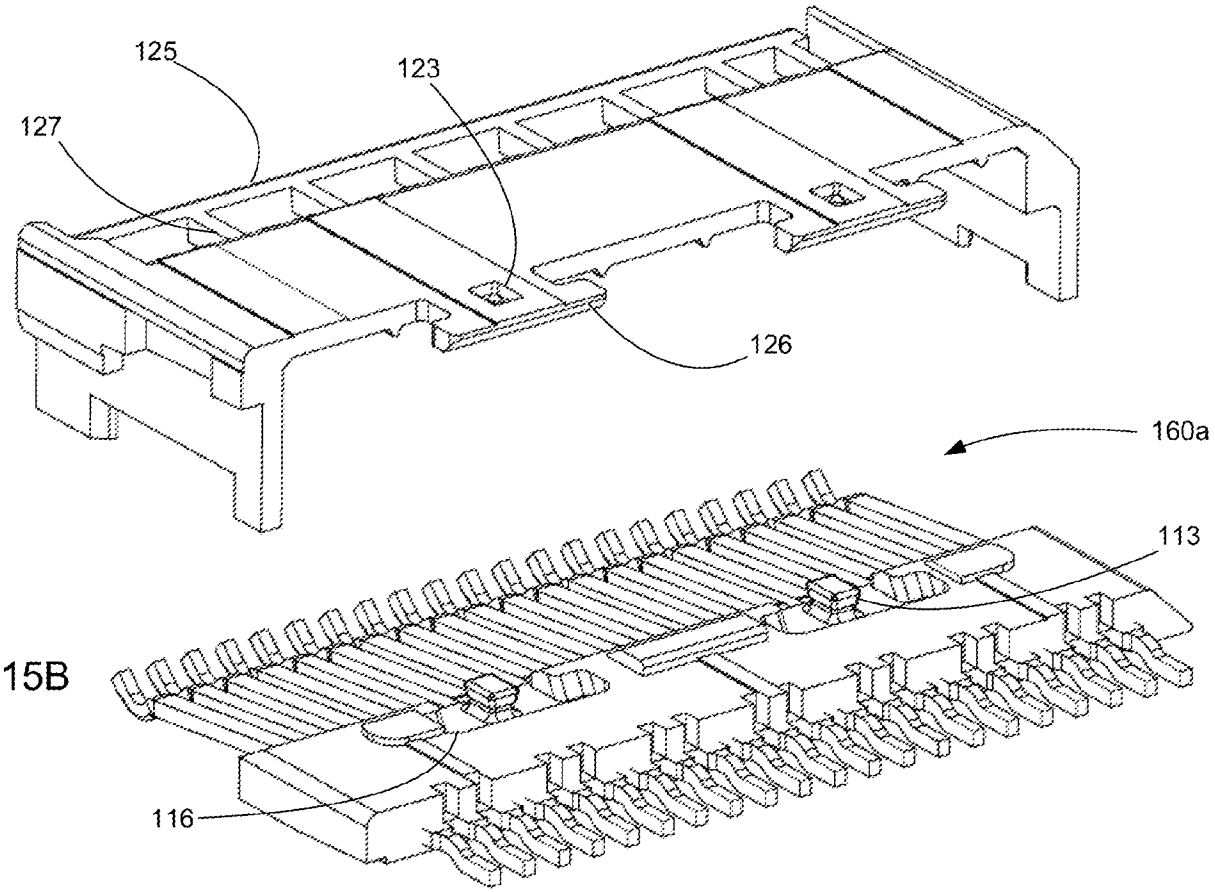
FIG. 15B illustrates a perspective exploded view of another half shell and a wafer
Figure 16:
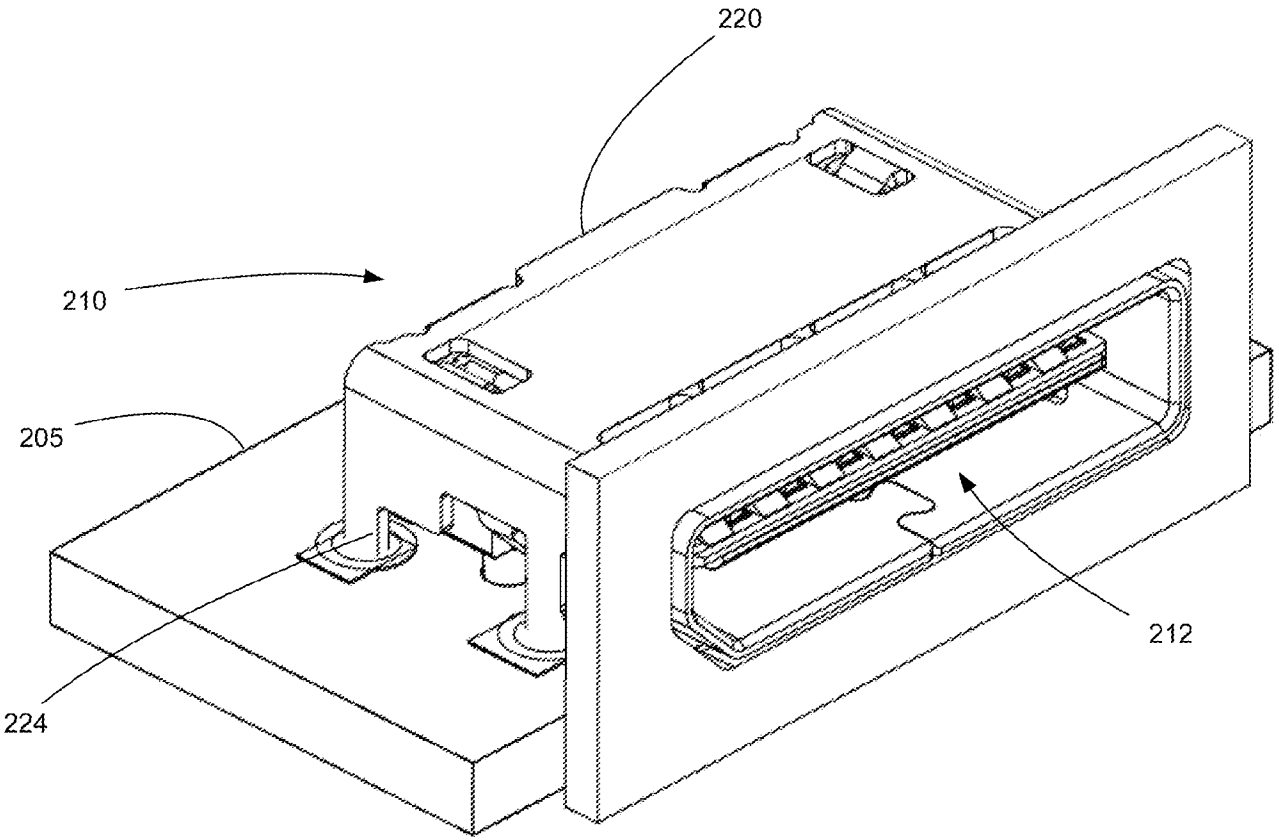
FIG. 16 illustrates a perspective view of an embodiment of a receptacle connector.
Figure 17:
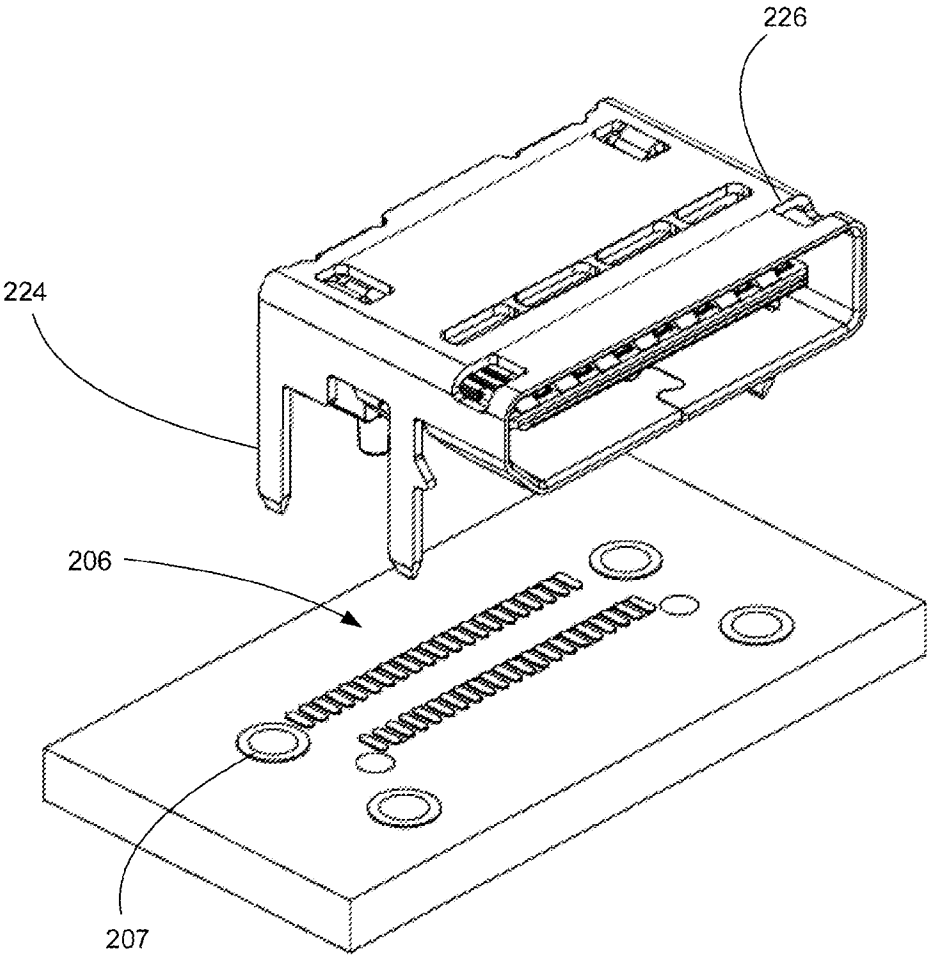
FIG. 17 illustrates a perspective simplified exploded view of the connector depicted in FIG. 16.
Figure 18:
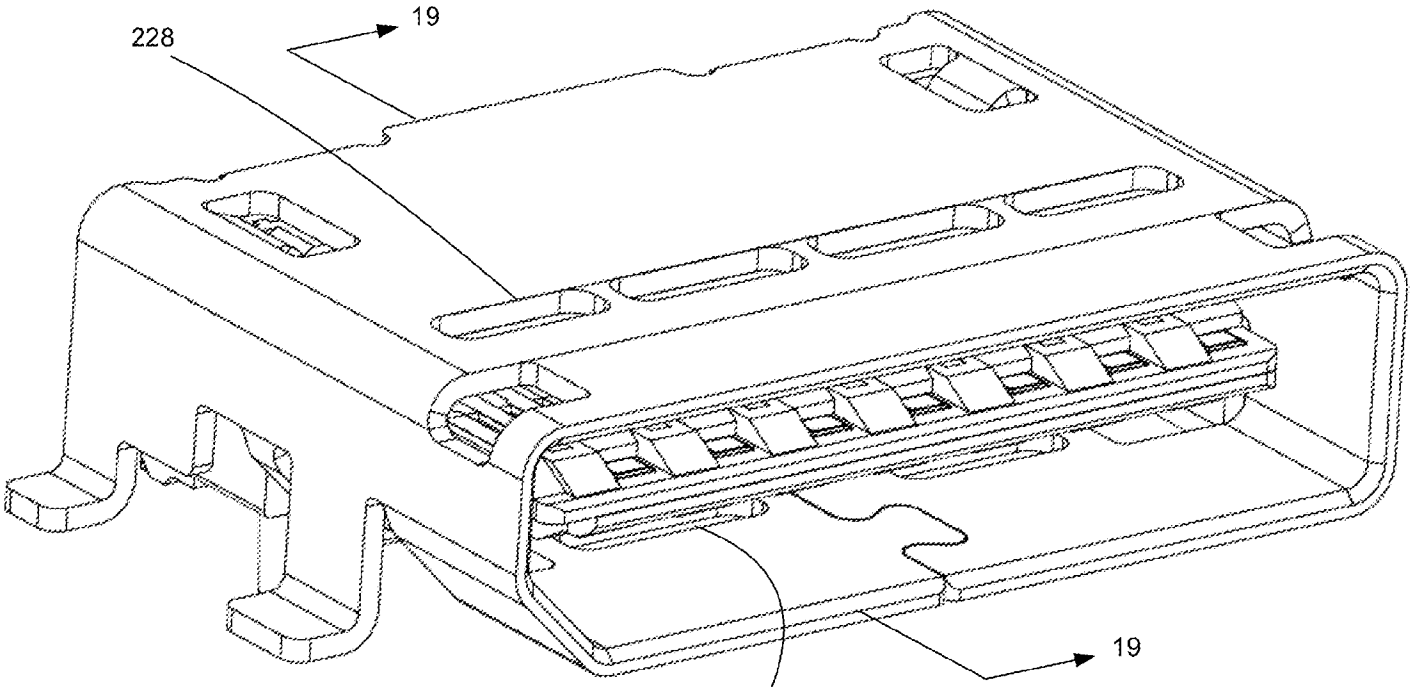
FIG. 18 illustrates a perspective view of another embodiment of a receptacle connector that has different mounting tabs than the embodiment depicted in FIG. 16.
Figure 19:
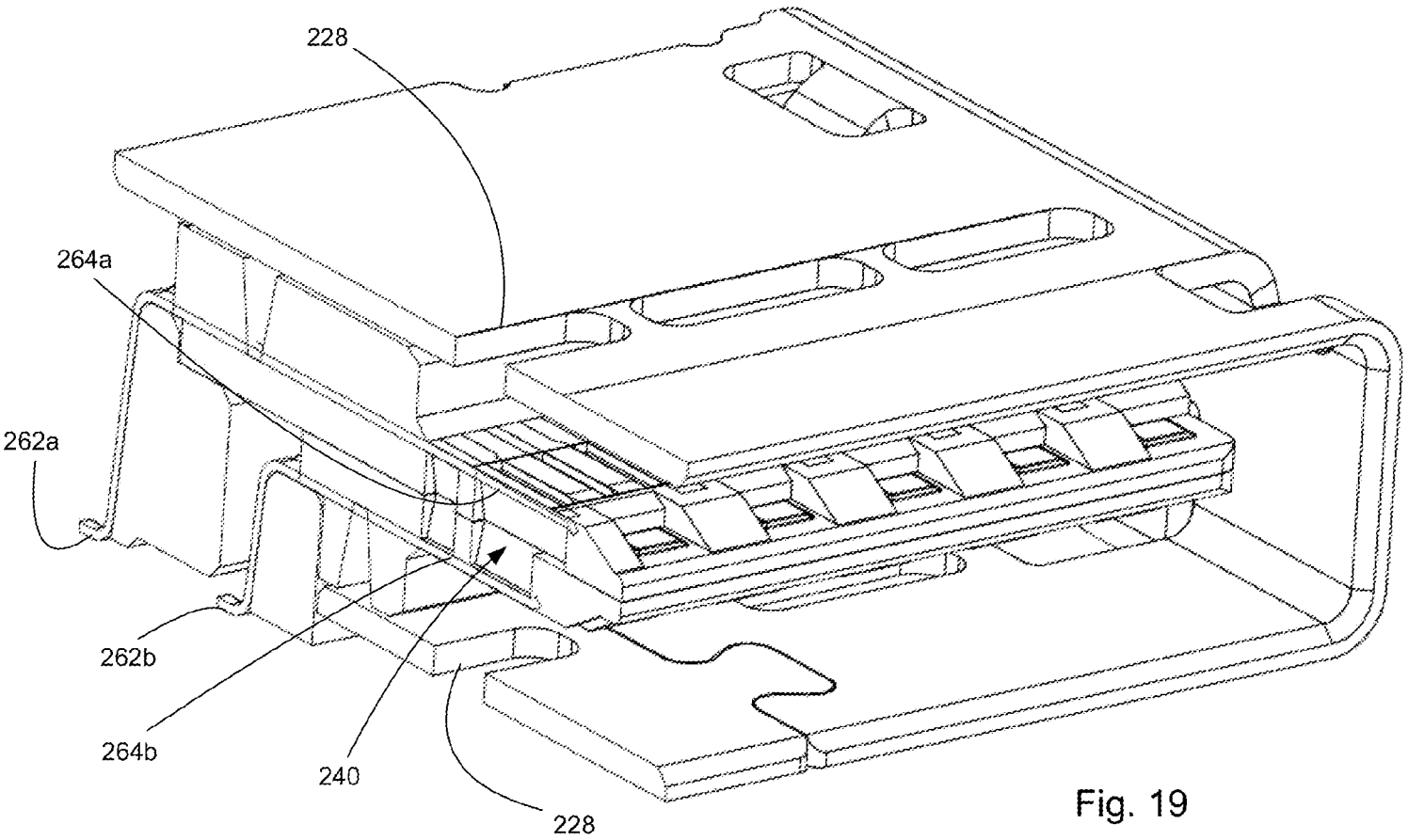
FIG. 19 illustrates a perspective cross-sectional view of the embodiment depicted in FIG. 18, taken along line 19-19.
Figure 20:
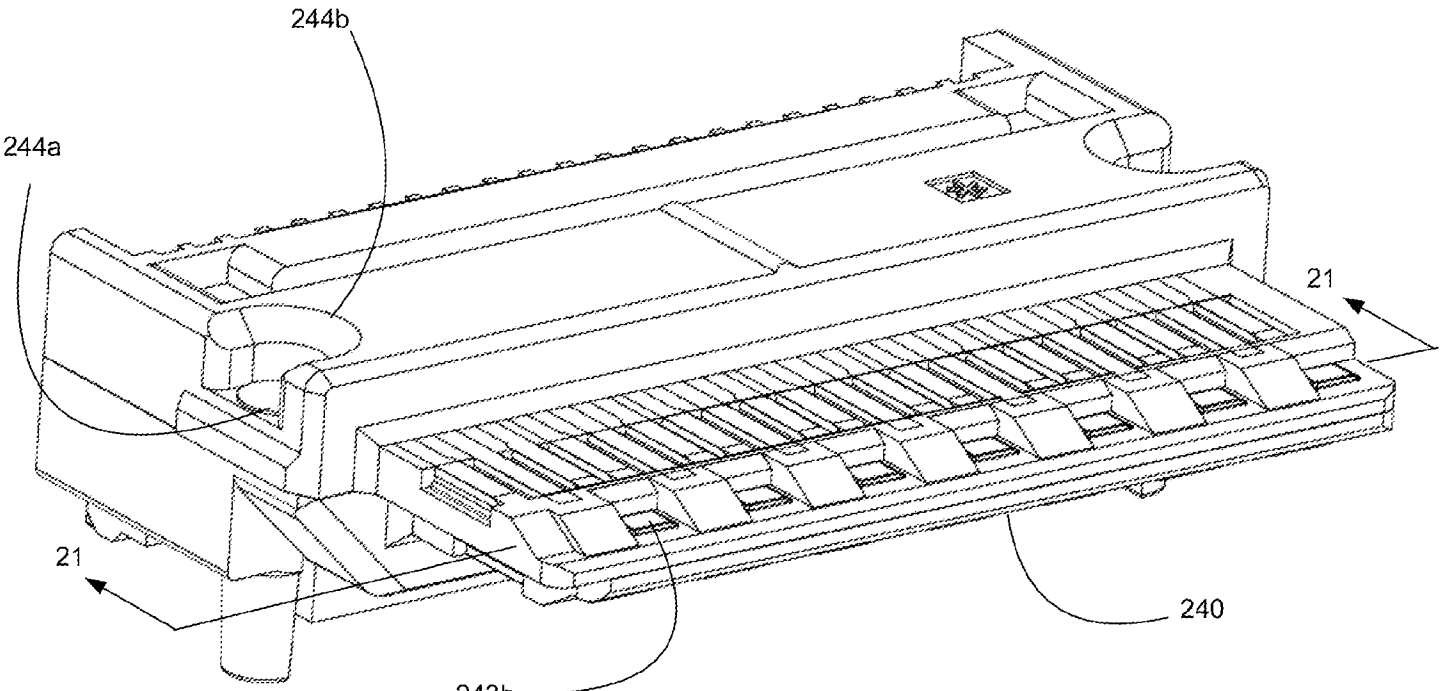
FIG. 20 illustrates a perspective simplified view of the embodiment depicted in FIG. 19.
Figure 21:
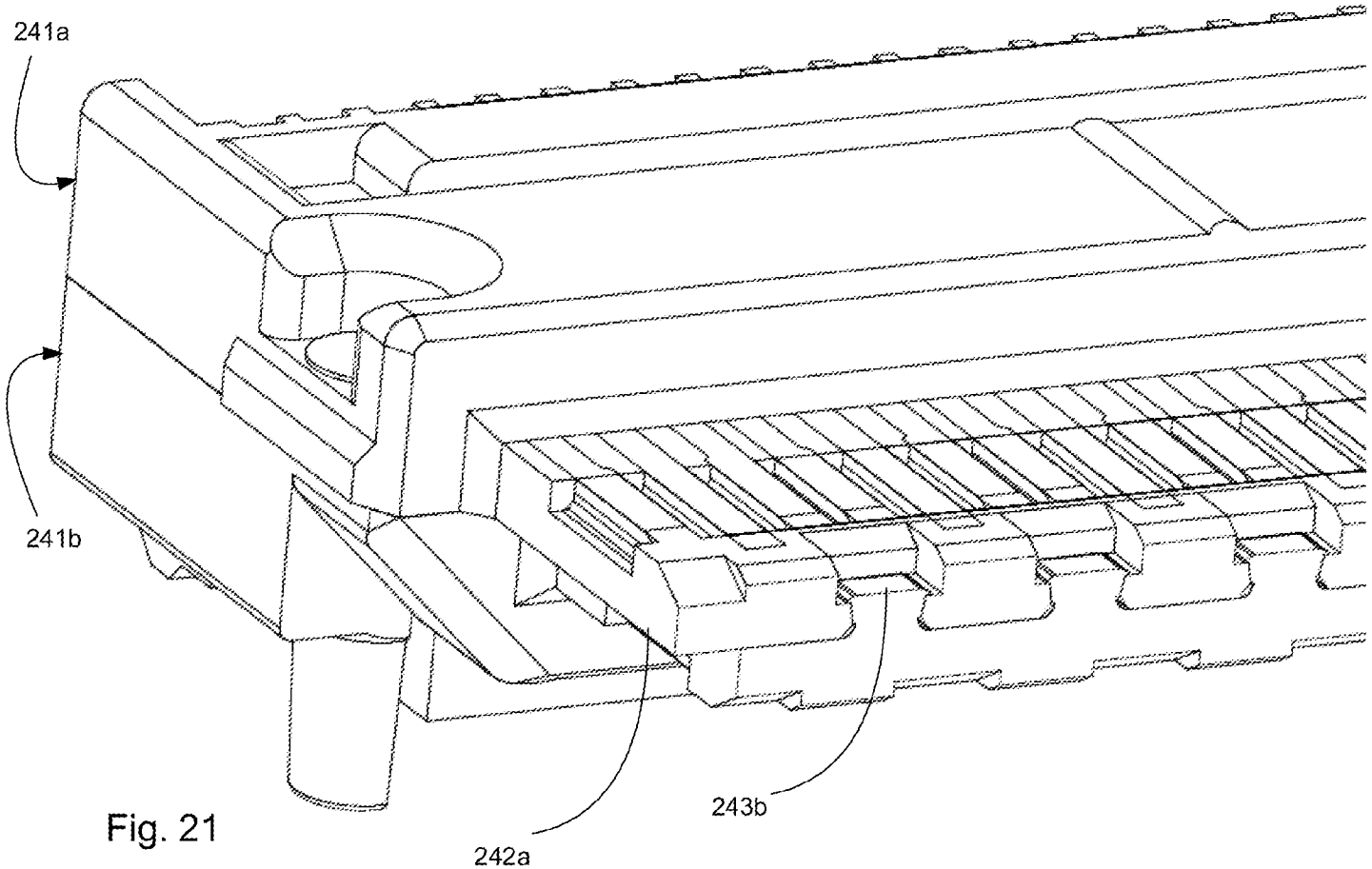
FIG. 21 illustrates a perspective cross-section view of the embodiment depicted in FIG. 20, taken along line 21-21.
Figure 22:
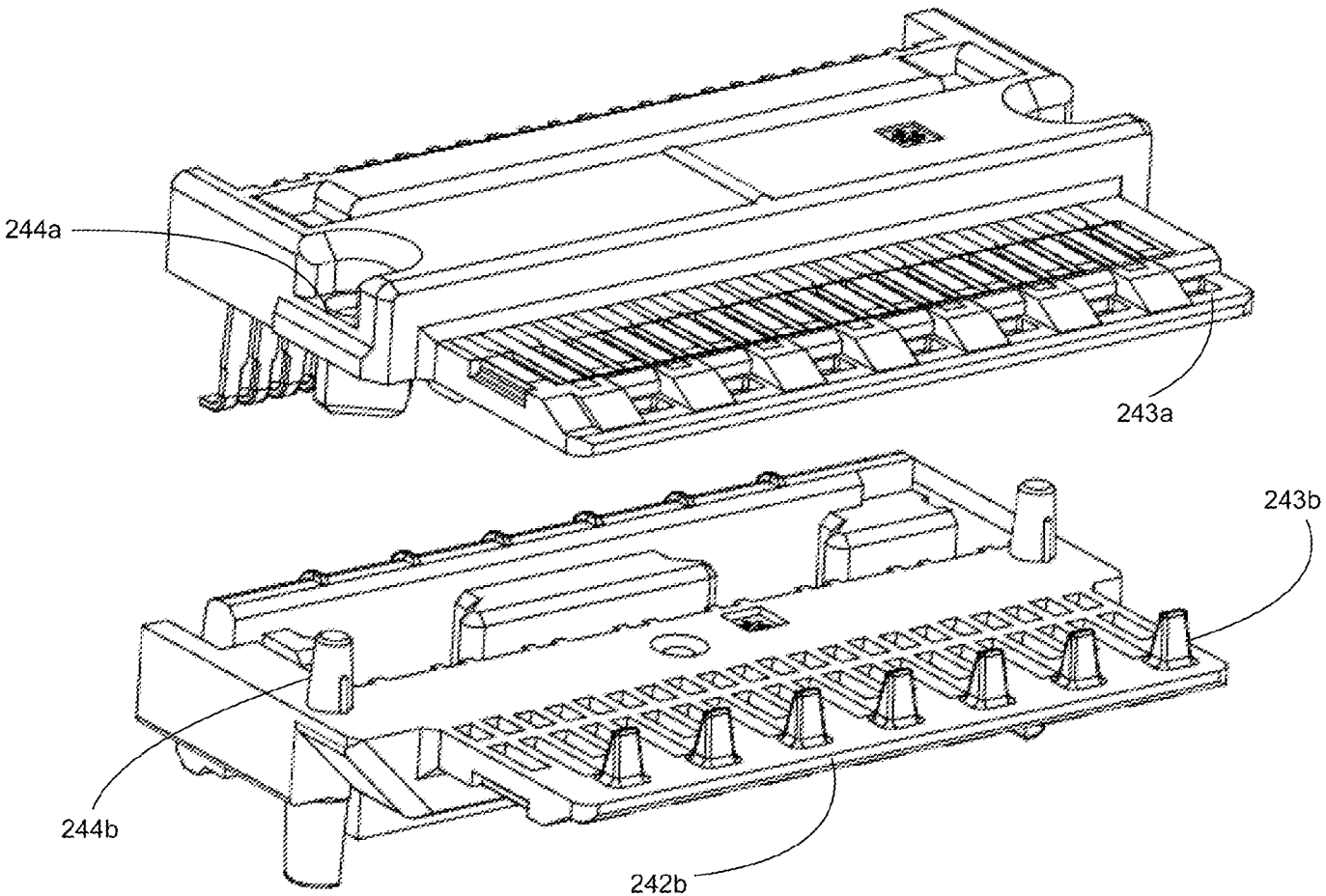
FIG. 22 illustrates a perspective exploded view of the embodiment depicted in FIG. 20.
Figure 23:
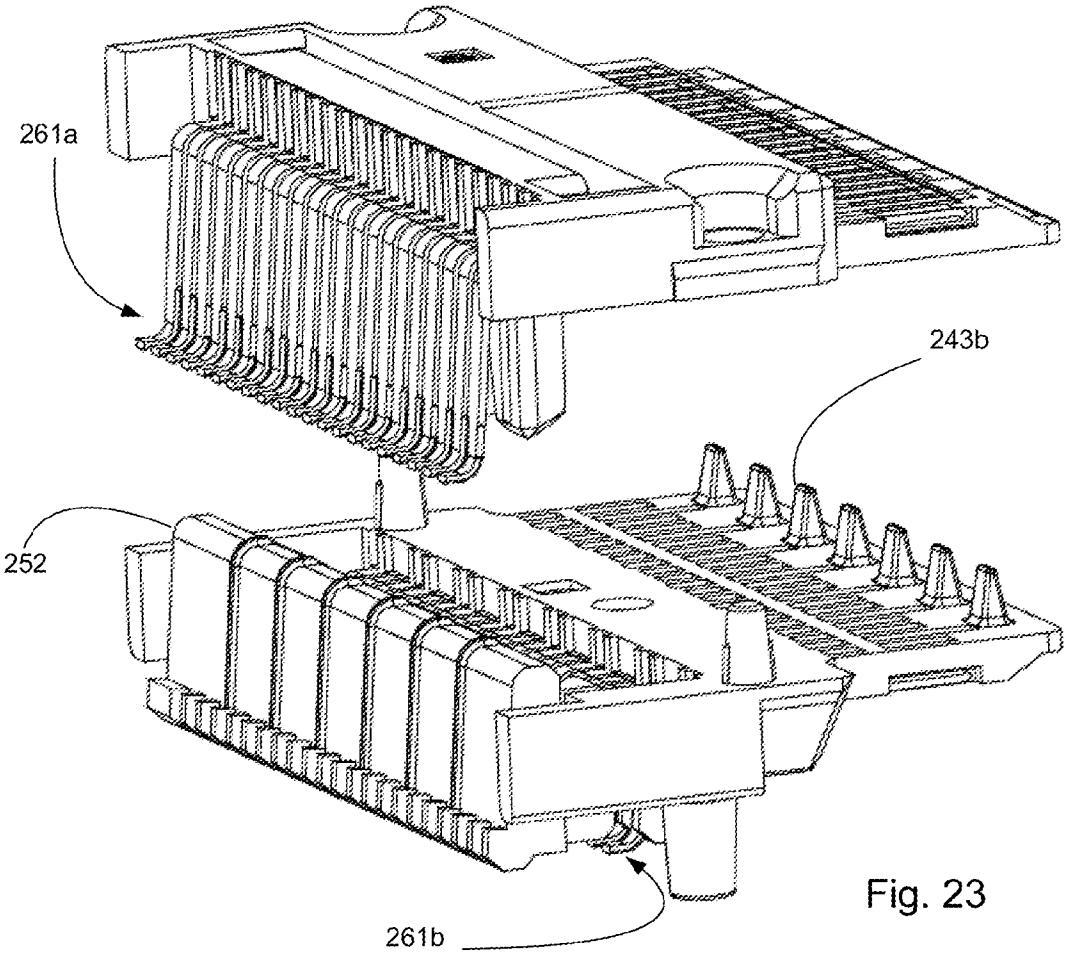
FIG. 23 illustrates another perspective view of the embodiment depicted in FIG. 22.
Figure 24:
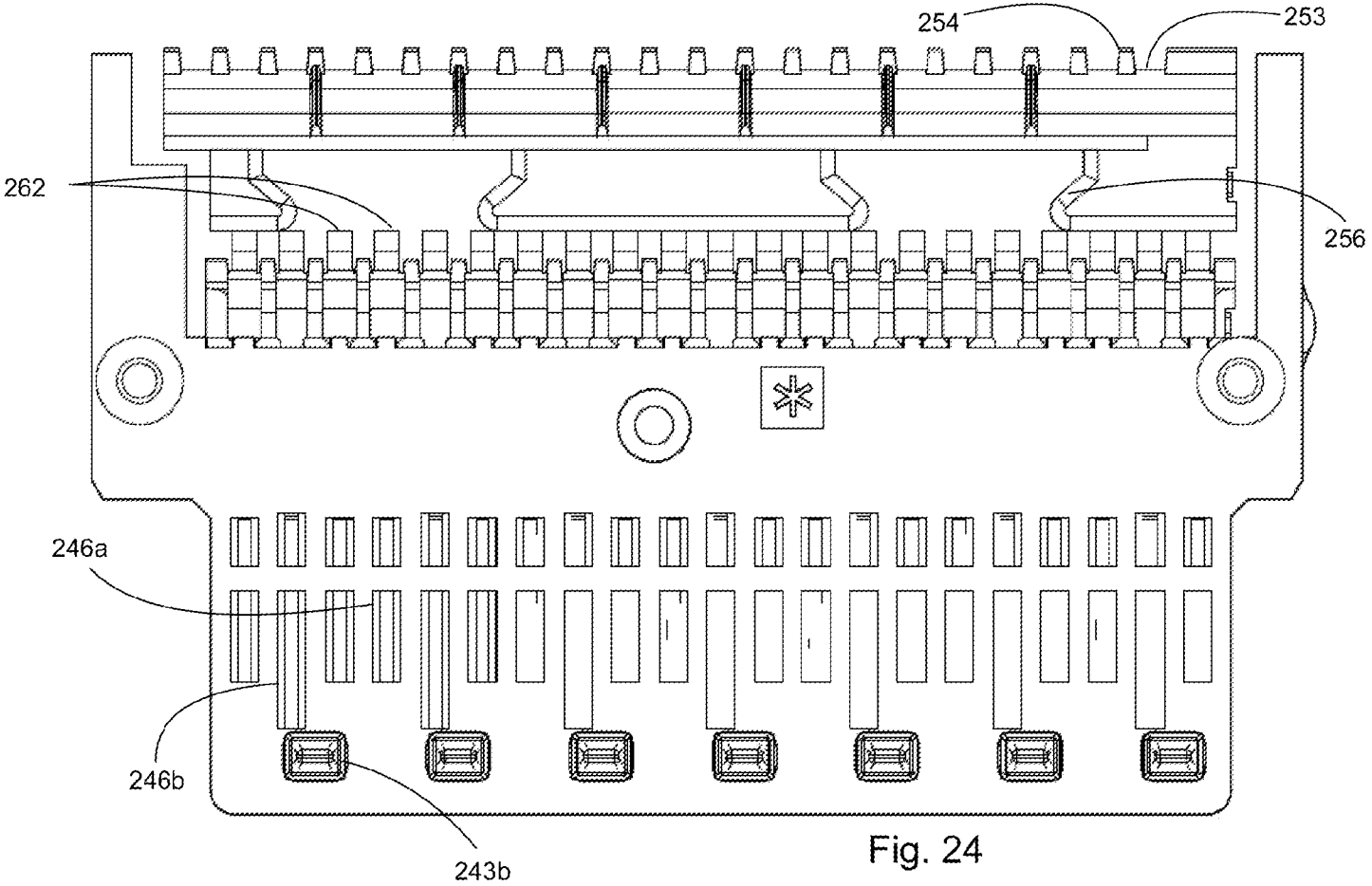
FIG. 24 illustrates a simplified plan view of the embodiment depicted in FIG. 23, showing just the bottom half of the connector.
Figure 25:
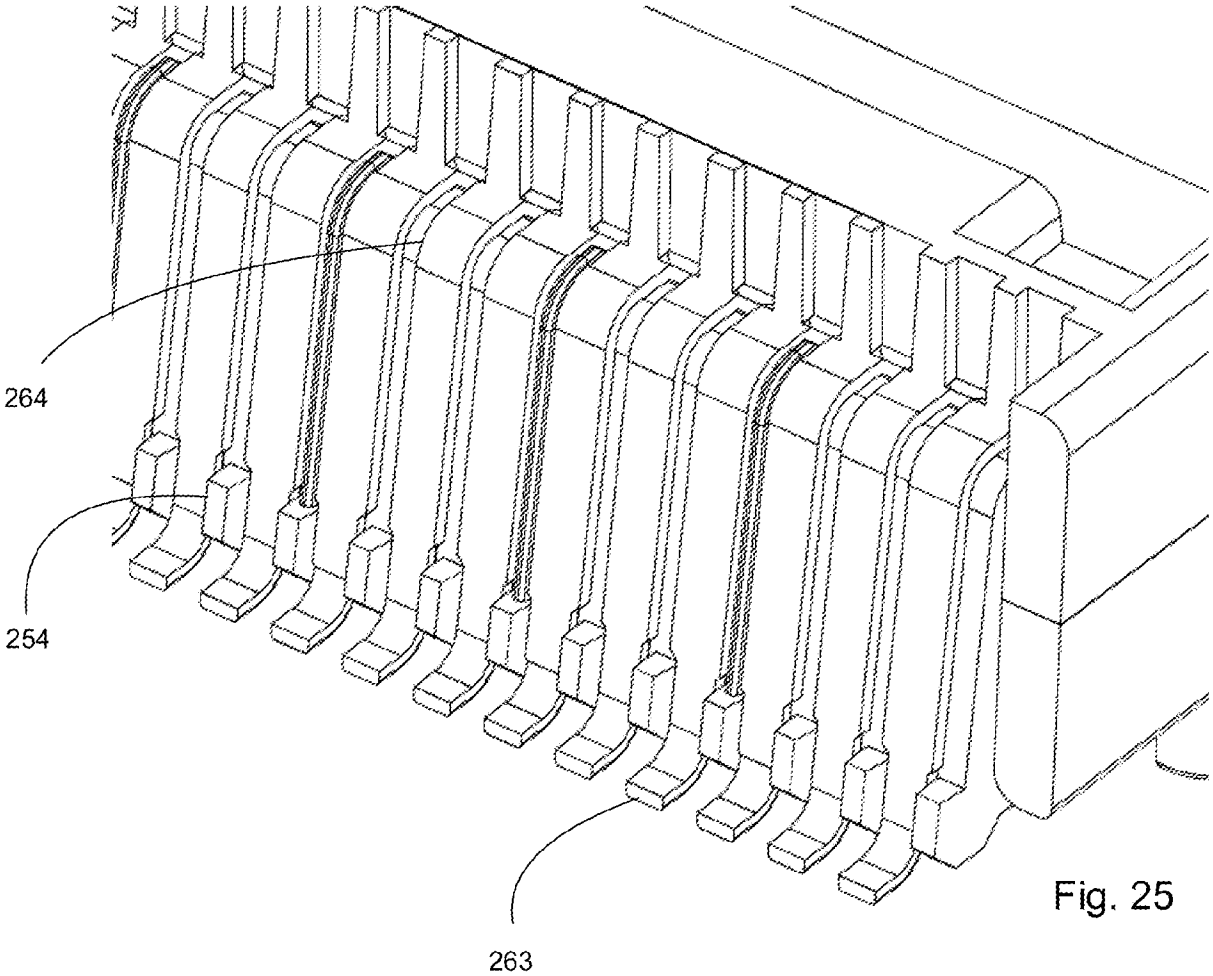
FIG. 25 illustrates an enlarged rearward perspective view of the embodiment depicted in FIG. 21.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

FIGS. 1A-15B illustrate features of an embodiment of plug connector assembly 5 that can mate to a connector 4. The depicted connector 4 has a right angle configuration with a port 3 and mounts on a circuit board 2. Naturally, other configurations of the connector 4 are contemplated and could include, without limitation, vertical, angled or cable mounted connectors. The plug connector assembly 5 is configured to provide an active latch feature (which tends to be desired in commercial settings such a server applications) but for consumer devices a passive latch system may be more desirable and then the active latch features can be omitted and the connector can be retained by a friction fit or with a depressible bump, as is known.

The depicted plug connector assembly 5 has a mating portion 12 and a body portion 14 and includes a pull block 8 that is coupled to latch actuator 7 by arms 9. A portion of the plug connector assembly 5 is enclosed in a cover 6 that can be formed as a two piece structure, as shown, and can be formed of an insulative material but if the cable assembly is intended for external use then it will be desirable to have shielding (either internal to the cover or by making the cover 6 with shielding built in). A sub-assembly 50 includes a circuit board 80 attached to a connector 55. The sub-assembly 50, as is known, would have a cable terminated to the circuit board 80 and a substantial part of the sub-assembly 50 can be positioned inside the cover 6. While the depicted embodiment illustrates a 4× configuration, other configurations, without limitation, such as 2× (which would be smaller) and 8× (which would be larger) are contemplated and the desired number of circuits can vary depending on the system design. Thus the depicted features are not limited to a particular number of terminals but instead are more generally applicable.

The connector 55 including a housing shell 56 that includes a first half shell 90 and a second half shell 120. The first and second half shells 90, 120 are configured to extend around wafers 100, 110 and help support terminals 150, 160 as will be discussed below.

As can be appreciated, the connector 55 includes an active latch system 65. As can be appreciated, alternative embodiments may omit the active latch if the application does not require one. The active latch system 65 includes an arm 68 that extends from a base 69 and the arm 68 has a latching finger 70 positioned on a distal end. The arm 68 can be folded from the base 69, which can extend from a rear edge of the shield 60 and extend forward so that a latching finger 70 is positioned in an aperture 71. As depicted, the aperture 71 is formed in corners of the top wall of the shield 60. In an embodiment vents 63 can be provided adjacent a front edge 61 of the shield 60 and these vents 63 can help provide cooling by allowing air to pass from one side of the shield 60 to the other side of the shield 60.

The shield 60 includes optional retaining fingers 66 that can be used to secure the shield to a circuit board 80. As can be appreciated, the depicted circuit board 80 includes pads 84 (which are provided in a row) that terminate to the terminals and may include a ground pad 88 that is aligned with the retaining fingers 66 and this can provide a ground commoning feature if desired. The circuit board 80 can include notch 89 and alignment ribs 88 to help control position of the circuit board 80 in the cover 6 and the circuit board 80 can be formed via conventional circuit board construction or can be formed via other additive processes, supports traces and provides a connection between conductors in a cable (not shown) and terminals in a connectors.

The wafers 100, 110 include insulative blocks 101, 111 that respectively support a terminals 150, 160 and the terminals 150, 160 are provided in a terminal row 150*a*, 160*a*. The terminals 150 include a tail 152, a contact 154 and a body 156 that extends therebetween. Similarly, the terminals 160 include a tail 162, a contact 64 and a body 166 that extends therebetween. The contacts can be arranged on a 0.5 mm pitch and are cantilevered so that the contacts can deflect. As can be appreciated, given the relatively small size, the deflecting contacts 154, 164 have to be carefully controlled in order to avoid damaging them while ensuring that the contacts 154, 164 mate with the corresponding stationary terminals on the mating connector. It turns out that it is challenging to ensure the relatively small deflecting terminals 150, 160 have sufficient contact force when mating with the stationary terminals while providing appropriate protection to avoid set or damage to the terminals 150, 160 and also providing appropriate lead-in so as to avoid stubbing, all while being designed so as to minimize stubs that will inhibit electrical performance as certain embodiments of the connector are intended to support 25 Gbps using non-return to zero (NRZ) encoding.

To help improve the robustness of the connector system from a mechanical interface standpoint, a biasing rail 95, 125 can be provided on the half shells 90, 120 and the biasing rails 95, 125 can be positioned in front of the terminals 150, 150. The biasing rails 95, 125 are supported by a number of arms 97, 127 in a cantilevered fashion and the biasing rails 95, 125 are intended in certain embodiments to urge an inserted mating blade from a corresponding mating connector toward a center position. The biasing rails 95, 125 overlaps the end of the contact 154, 164 and thus helps occlude the front of the terminals so that an inserted mating blade does not stub on the terminals 150, 160. Specifically, the biasing rail 95, 125 is positioned in front of the terminals 150, 160 with an inner edge AA of the biasing rail positioned closer to the center of the card slow than a front edge BB of the terminal 150, 160 as to provide an initial barrier to a mating connector. Thus, when the mating blade of a mating connector is inserted toward the biasing rail 95, 125 the biasing rail 95, 125 urges the mating blade to pass over the front edge of the terminals 150, 160 and thus helps prevent stubbing. Thus the biasing rail 95, 125 helps direct a mating connector into the proper mating position while minimizing the potential for stubbing and/or damage to the terminals 150, 160.

As can be appreciated from the Figs, the housing shell 65 is secured to the wafers 100, 110, which are secured to the circuit board 80. Specifically, the first half shell 90 includes an arm 96 that inserts into a pocket 106 of the wafer 100. A locking finger 103 is inserted into a locking aperture 93 in the arm and helps retain the arm 96 in the pocket 106. In an embodiment the locking aperture 93 includes a negative taper such that when the locking finger 103 is flattened and swaged to form a rivet like structure the locking finger 103 will expand at the top and resist being pulled out of the locking aperture 93. Similarly, the second half shell 120 includes an arm 126 that inserts into pocket 116 of the wafer 110. A locking finger 113 is inserted into a locking aperture 123 and flattened and swaged into place. Thus the housing shell 65 and the wafers 100, 110 are securely held together.

It has been determined that because of issues with co-planarity and tolerances, it is difficult to accurately ensure the tails are precisely aligned on the circuit board 80 while not disturbing the position of the contacts in the card slot. In operation, the first wafer 100 includes a first peg 102 that extends from the first wafer 100 and the second wafer 110 includes a second peg 112 that extends from the second wafer 110. The pegs 102, 112 can engage each other through a cutout 87 in the circuit board 80 so as to form a support column 79. Multiple support columns 79 are preferred for maximum stability. The cutout 87 preferably is large enough to provide a clearance around the pegs 102, 112 and allows the wafers to be pressed against each other so that the pegs control the spatial relationship between the wafers 100, 110 and the cutout 87 can be positioned in an interior of the circuit board 80 so as to provide an aperture. Preferably the wafers 100, 110 can be configured so that the pegs 102, 112 can bottom out without needing to directly touch the circuit board 80. This is because, when first and second pegs 102, 112 bottom out against each other to form a mating line 130, the first and second pegs 102, 112 can provide a highly controlled distance between the wafers 100, 110 that has a tighter tolerance than can be maintained if the wafers physically press against the circuit board 80. If desired, the first and second pegs 102, 112 can optionally be secured together with an adhesive. If desired, the first wafer 100 and the second wafer 110 can each include a plurality of pegs 102, 112 so there are two or more locations where the pegs from the first and second wafers 100, 110 engage each other. In certain embodiments the pegs will form a mating line that is between a top surface 85*a* and a bottom surface 85*b* of the circuit board 80 and can be internal to the circuit board, such as is depicted if FIG. 4B, so as to form a robust and compact structural configuration.

Regardless of the quantity of pegs, the first and second pegs 102, 112 can be manufactured with a high level of dimensional control and help ensure the two wafers 100, 110 are spaced apart a desired and controllable distance. It should be noted that if desired, a single longer peg can be used on just one wafer and then the longer peg would press against a surface of the insulative block of the other wafer instead of a peg and the mating line would not be arranged between opposing surfaces of the circuit board. Longer pegs tend to be more difficult to use as the wall thickness variation can cause issues with molding and thus the use of two shorter pegs instead of one long peg, while not required, may be preferred.

The first and second wafers 100, 110 are secured to the circuit board with a shim 170, which can be an adhesive and the shim 170 can be deflected/compressed between the wafers 100, 110 and the circuit board 80 during installation of the connector onto the circuit board 80. Once the shim 170 sets and is cured it will securely fasten the wafers 100, 110 to the circuit board 80 without the need for the wafers 100, 110 to directly contact the circuit board 80. As can be appreciated, the shim 170 allows the circuit board 80 to have a small range of Z-direction tolerance with respect to the position of the first and second wafers 100, 110 relative to the circuit board 80 while securely mounting the first and second wafers 100, 110 to the circuit board 80 so as to provide structural rigidity. The tails 152, 162 can be carefully aligned to the pads 84 in the x and y direction (e.g., along the top and bottom surfaces 85*a*, 85*b* of the circuit board), either with the use of optical sensing or other desirable process controls, and then attached to the pads 84 via reflow. As can be appreciated, the tails 152, 162 can be aligned so that they are positioned over the pads 84 but not touching the pads 84 and then the use of solder allows any small variation in the Z direction between the location of tails 152, 162 and the pads 84 on the circuit board 80 to be compensated for and thus makes the entire assembly process relatively robust.

It turns out that it is relatively valuable to control the position of the terminals 150, 160, relative to the housing shell. Specifically, the terminals 150, 160 preferably are positioned so that the biasing rail 95, 125 can provide the desired anti-stubbing benefits. The depicted design helps ensure that the position of the housing shell 65 is based on the location of the first and second wafers 150, 160, which directly control the position of the terminals, and thus the dimensional stack-up of the biasing rail 95, 125 relative to the contacts 154, 164 can be better controlled.

The depicted housing shell is a two-piece design that is securely mounted to the two wafers, which are in turn securely mounted to the circuit board. As can be appreciated, the shell 60 is mounted to the front housing/wafers. A top wall 61*a* of the shell 60 can include a protrusion 64 that is formed to improve rigidity and strength and the parting line can be welded together. A bottom wall 61*b* of the shell 60 can also include a protrusion 60 similar to the protrusion on the top wall. The protrusion(s) 60 can engage retention blocks 104, 114, as is disclosed in FIGS. 4D and 4E, and this allows the shell 60 to be securely mounted to the housing shell 65 (with the retaining fingers engaging the circuit board providing additional mounting security). As the first wafer 100 presses against the second wafer 110 via the pegs 92, 112 and is also securely mounted to the circuit board 80 via the shim 170, the resultant design provides a mechanically continuous structure between the top wall 61*a* and bottom wall 61*b* that forms an effective laminate structure that can offer increased structural rigidity.

As noted above, the plug connector can mate to a board mounted receptacle connector. Features of exemplary right angle receptacle connector are depicted in FIGS. 16-25. Specifically, a connector 210 is mounted on circuit board 205. The connector 210 includes a cage 220 that defines a port 212. The cage 220 includes legs 224 that can be solder-attached to the circuit board 205 (either using a through-hole configuration or an SMT configuration) while the terminals are connected to a pad array 206 and the cage 220 includes a securing aperture 226 that can receive a latching finger 70.

The connector 210 includes a first terminal block 241*a* and a second terminal block 241*b* that are secured together to form a connector with a mating blade 240 and the terminals blocks support terminals 262. The first terminal block 241*a* has a tongue 242*a* and the second terminal block 241*b* has a tongue 242*b* that are secured together via securing fingers 243*b* being inserted into and flattened and swaged in securing apertures 243*a*. Similarly, securing pegs 244*b* are flattened and swaged into securing aperture 244*a*. Thus the first and second terminal blocks 241*a*, 241*b* can be held together.

Vents 228 are provided on opposing side of the cage 220 so as to allow air to flow between the opposing sides. To allow air to flow therebetween, notches 246*a*, 246*b* are provided in the tongues 242*a*, 242*b*. If the terminals 262 are configured so that air can flow past them into the notches 246*a*, 246*b* then air can flow through the mated interface.

To provide for good performance the notches 246*a*, 246*b* can also be sized so that the terminals have a desired impedance profile. The terminals 262 can have tails 262*a*, 262*b* that are on a constant pitch while the body 264 are spaced apart so that terminals have differential coupling and are preferentially coupled. An aligning block 252, which can be supported by support arms 256 and the aligning block 252 can include nubs 254 and channels 253 to control the location of the terminals so that a first row 261*a* and a second row 261*b* are provided in a consistent and repeatable manner.

Figure 26A:
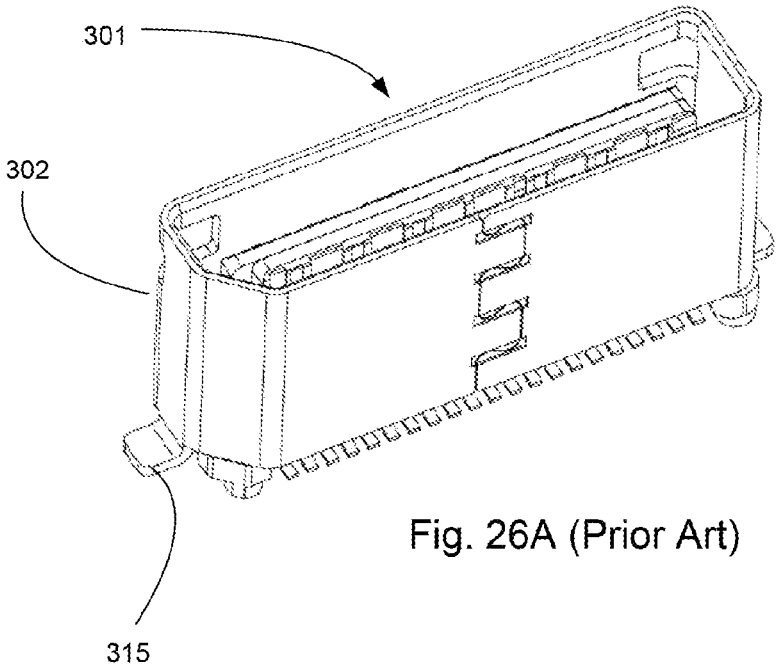
Fig. 26A (Prior Art)
FIG. 26A illustrates a perspective view of a prior art connector.
Figure 26B:
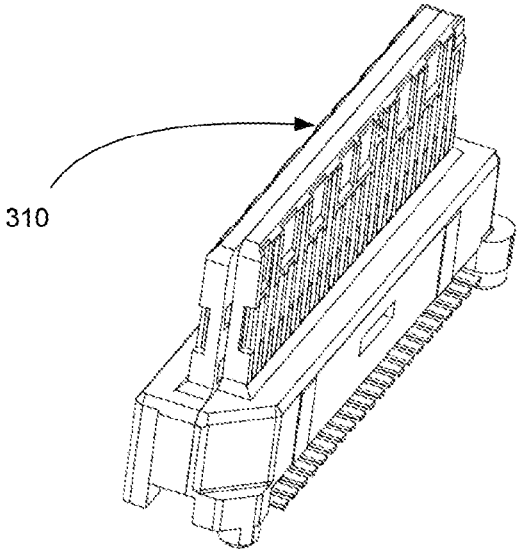
Fig. 26B (Prior Art)
FIG. 26B illustrates a simplified perspective view of the connector depicted in FIG. 26A.
Figure 27:
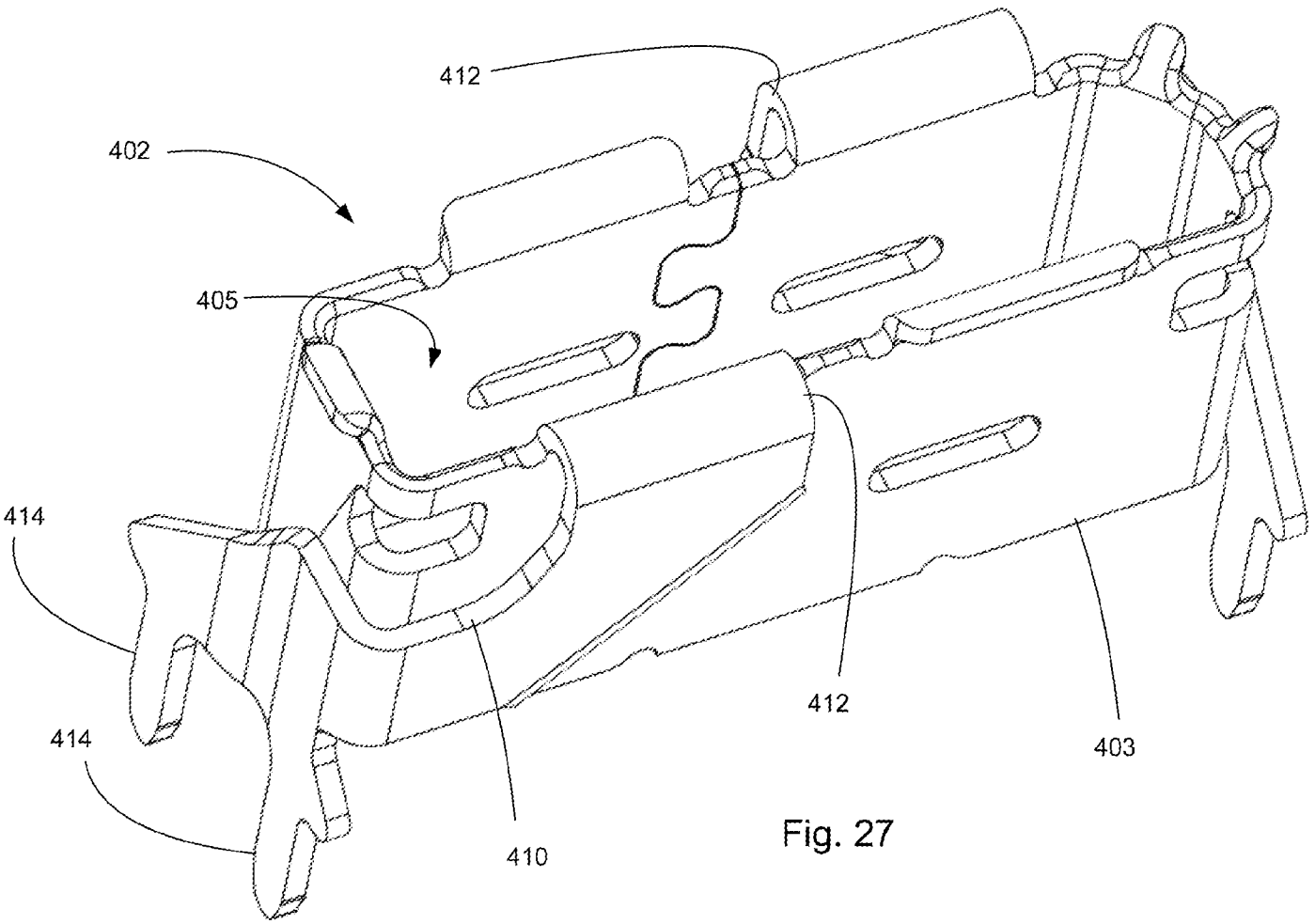
FIG. 27 illustrates a perspective view of an embodiment of a cage suitable for use with the connector depicted in FIG. 26B.
Figure 28:
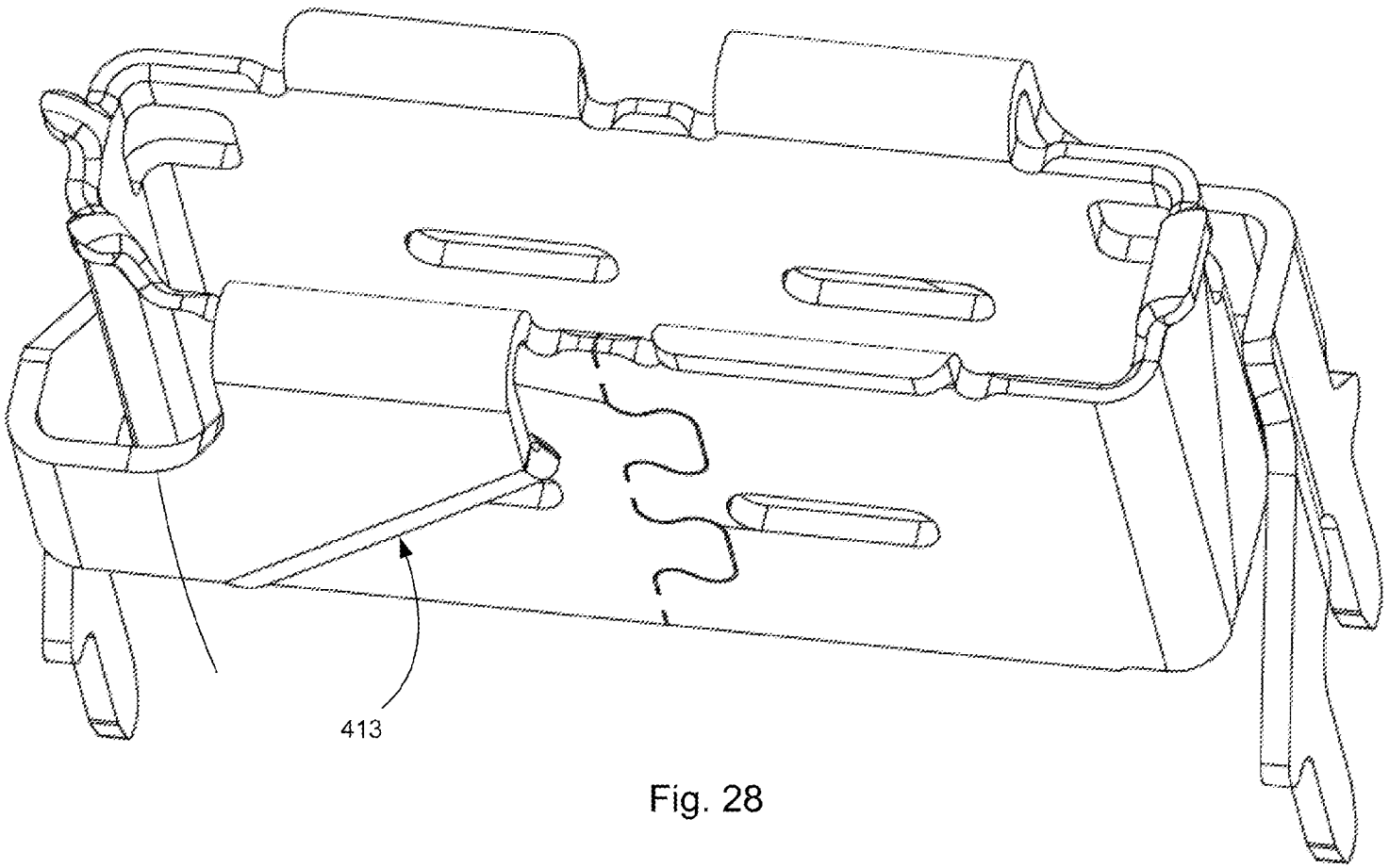
FIG. 28 illustrates another perspective view of the embodiment depicted in FIG. 27.
Figure 29:
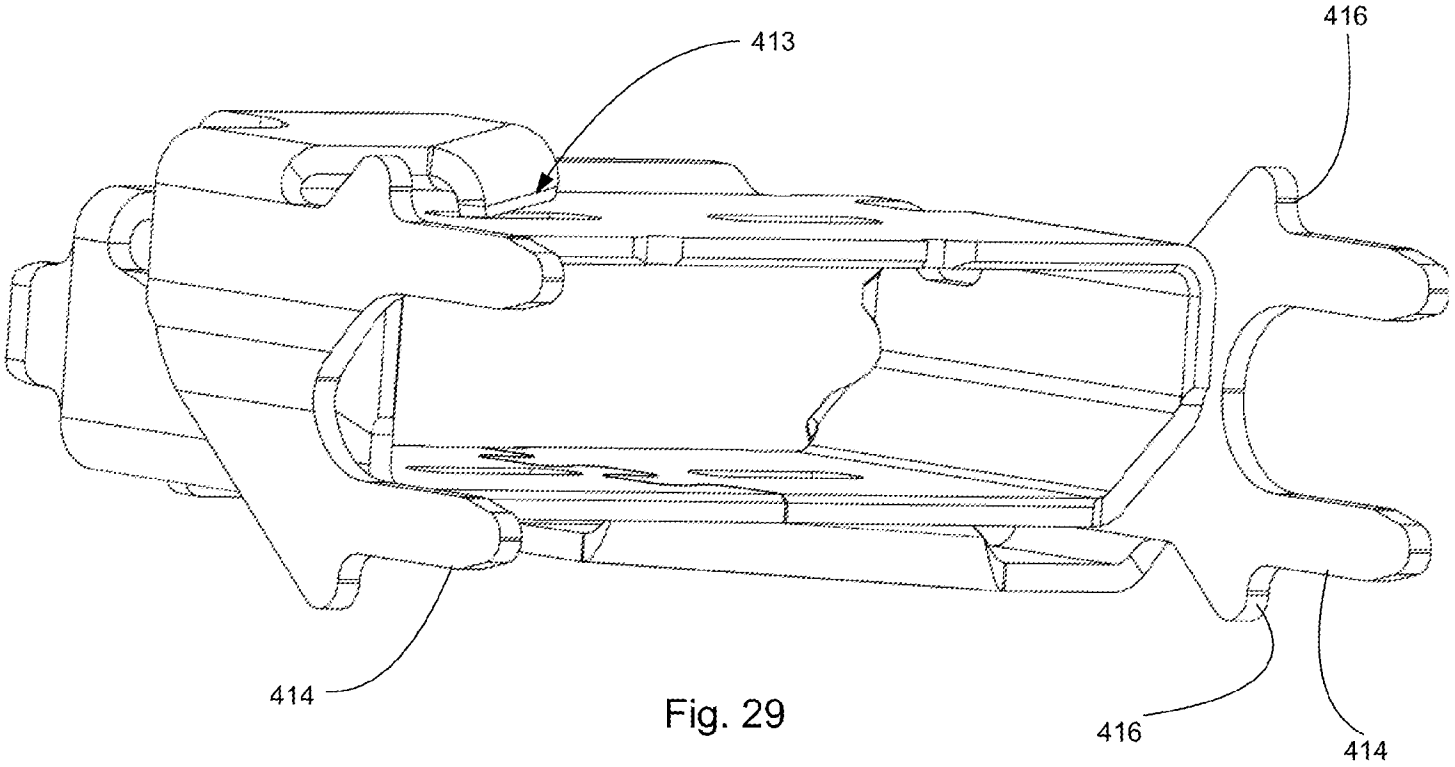
FIG. 29 illustrates another perspective view of the embodiment depicted in FIG. 27.
Figure 30:
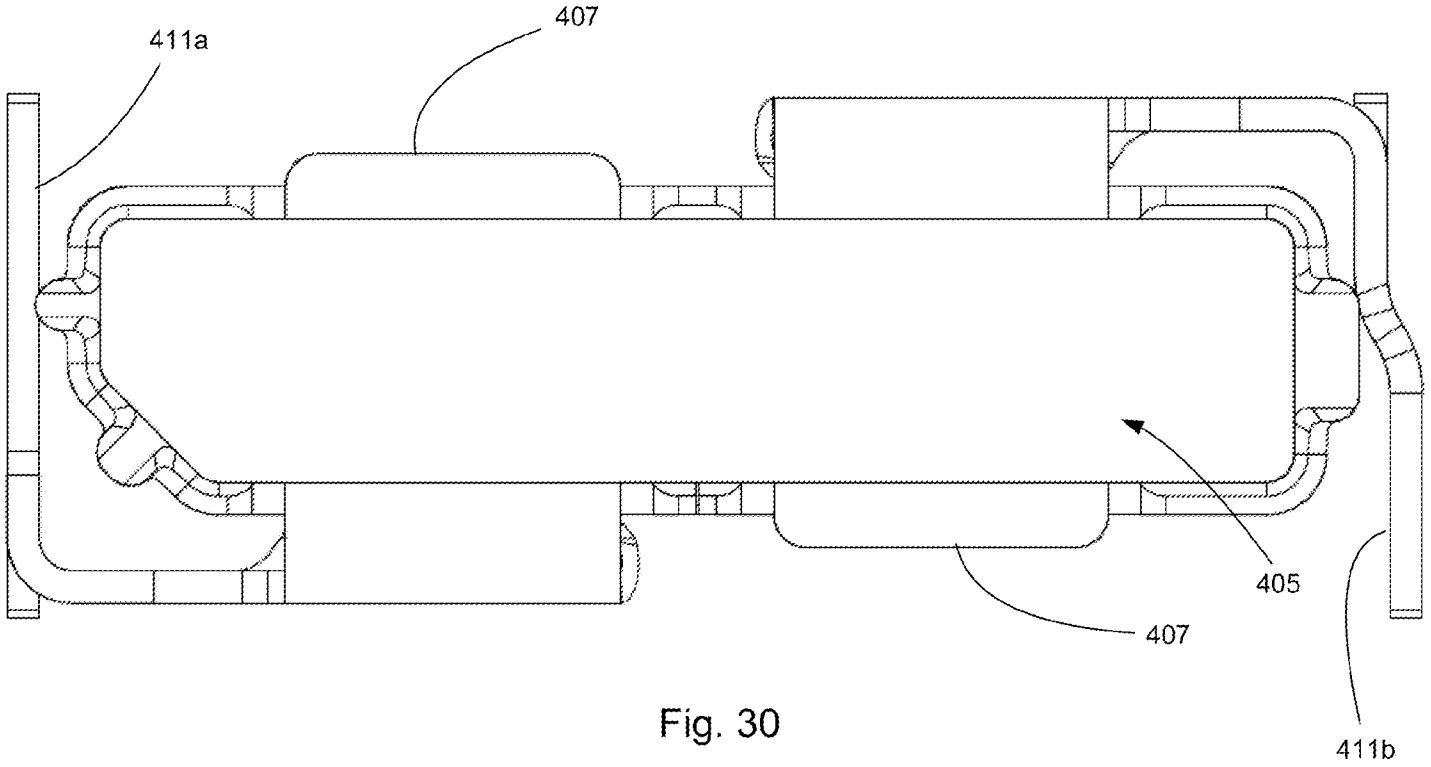
FIG. 30 illustrates a plan view of the embodiment depicted in FIG. 27.
Figure 31:
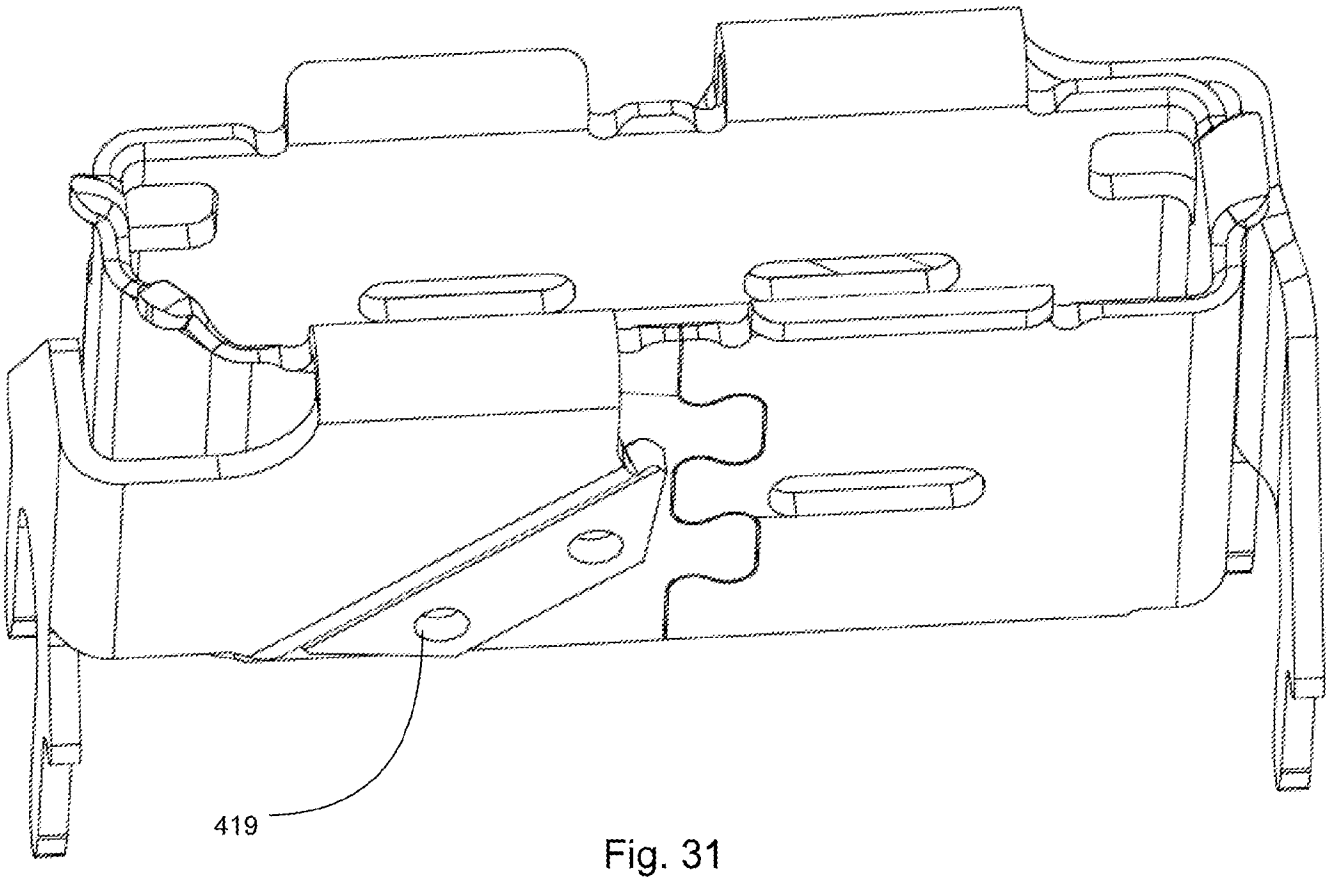
FIG. 31 illustrates a perspective view of another embodiment of a cage suitable for use with the connector depicted in FIG. 26B.
Figure 32:
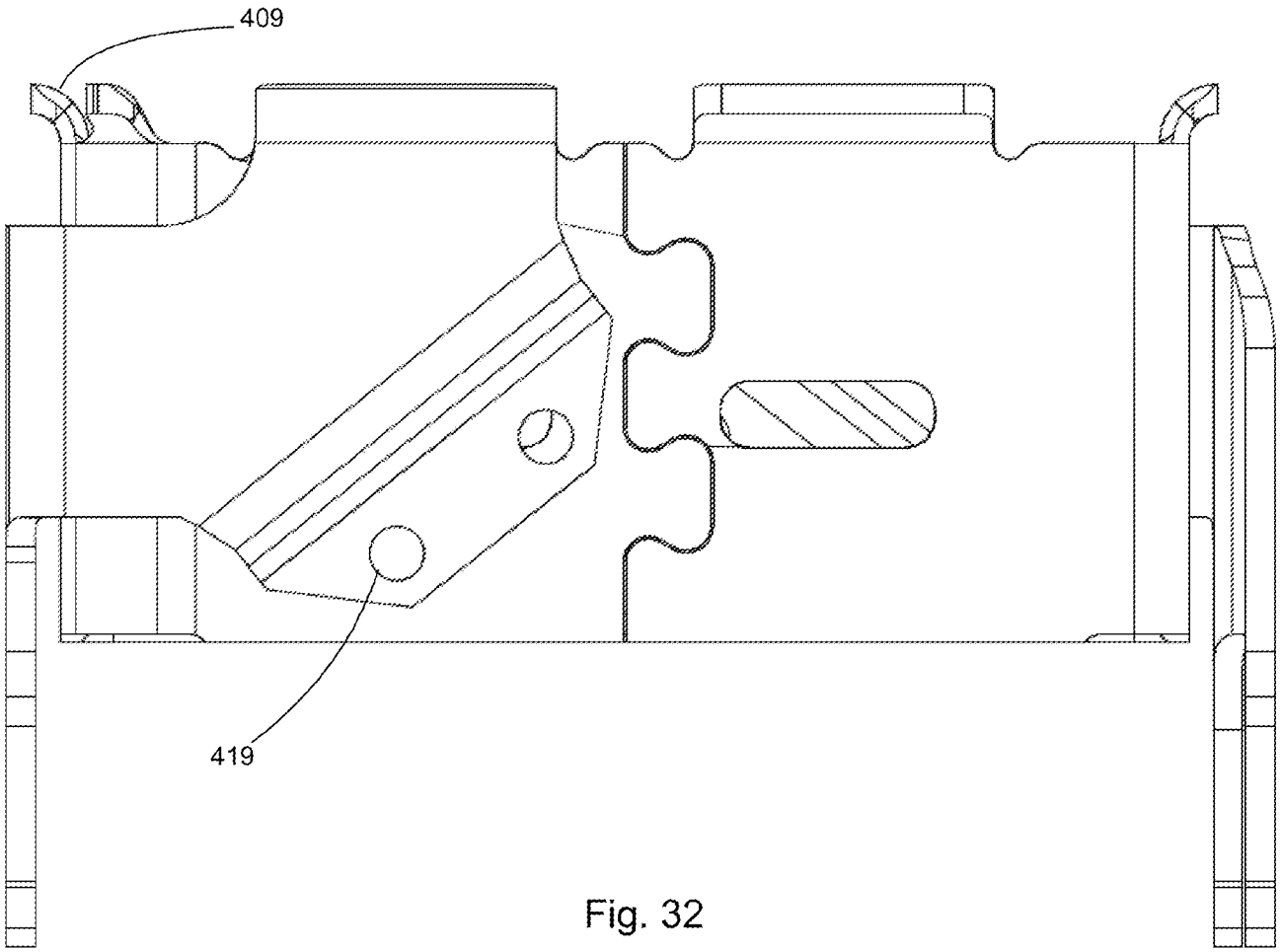
FIG. 32 illustrates an elevated side view of the embodiment depicted in FIG. 31.

FIGS. 26*a*-26*b* illustrate an existing vertical design. As can be appreciated, the shield 302 mounts around a housing 310 and the shield 302 has two solder tabs 315 that help support the shield in position. It has been determined that additional support may be desirable for certain applications. One possible alternative is to use a through-hole solder attach instead of a simple SMT (putting a tail on the shield 302). It turns out that using a single through-hole solder attach method results in improvements but may not be sufficient for all use cases. Attempting to use additional tails is difficult as the vertical connector includes pegs that help align the connector with a supporting circuit board.

It has been determined that an alternative version of a cage can be used to hold a vertical connector in place. Two tails can be provided and can be supported by an arm that extends from the top of the shield. Two arms could be used to maximum strength but in an alternative embodiment a single arm can be used and the other side of the terminal can have a single tail positioned closer to the center. The arms can be shaped to help improve lead-in when mating to the vertical connector. Preferably the arms are positioned in opposite corners so as to allow the part to be designed from a single blank. If desired, the arms can include folds and can be welded to the shield adjacent the apertures in the arms so as to provide increased strength.

It should be noted that the tails can be jogged or offset on one side so as to allow two connectors to be mounted belly-to-belly to the same circuit board. In many applications, however, the vertical connectors will all be positioned on the same side of a circuit board and thus the offset tails are not required. The depicted design allows for improved pull-off force and the flanges on both sides of the tails help minimize angular rocking of the shield.

FIGS. 27-34 illustrate features of embodiment of a shield 402 that is more suitable for resisting deformation and pull forces. The shield 402 has a body 403 that defines an opening 405 and has two arms 410 that extend from the body 405 upward from opening and then extend downward via a folded section 412. At a distal end of the arms 410 are a plurality of legs 414 that are intended to be soldered into a circuit board. Shoulders 416 help ensure that the legs 414 are not over inserted into the circuit board and also provide additional surface area for soldering to the circuit board for improved pull-off force. To provide additional robustness, a seam 413 is provided on the arm 410. The seam 413 can be welded to or attached via an adhesive material so that the arm 410 is attached to the body 403, thus strengthening the arm 410.

To aid in mating with a plug connector, the shield 402 can include lead-in features 407 and 409. The shield 402 can have an alternative design that includes tack welds 419 to secure the arm 410 to the body 403. Regardless of the use of lead-ins, the arms 410 can have a first base 411*a* that is straight and a second base 411*b* that has an offset (which as noted above, can help with bell-to-belly configurations).

Figure 33:
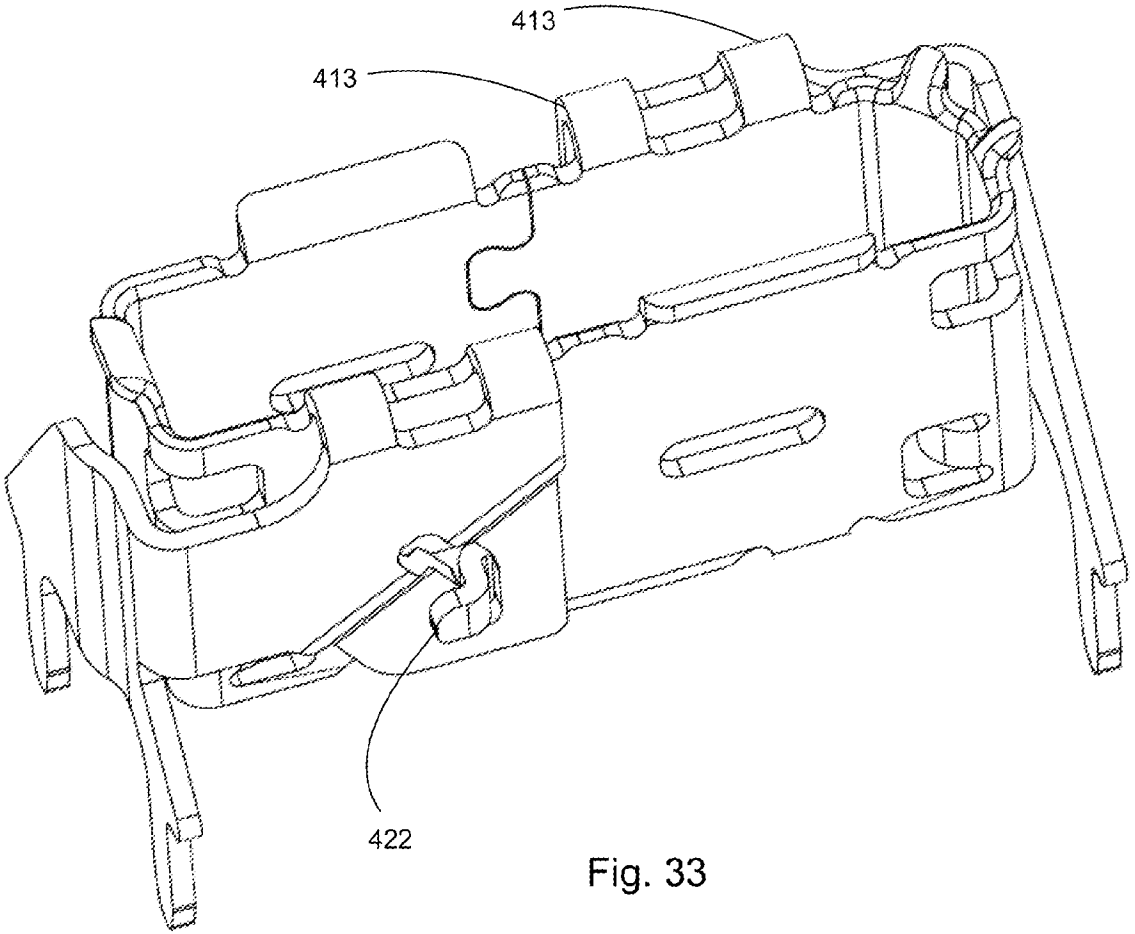
FIG. 33 illustrates a perspective view of another embodiment of cage suitable for use with the connector depicted in FIG. 26B.
Figure 34:
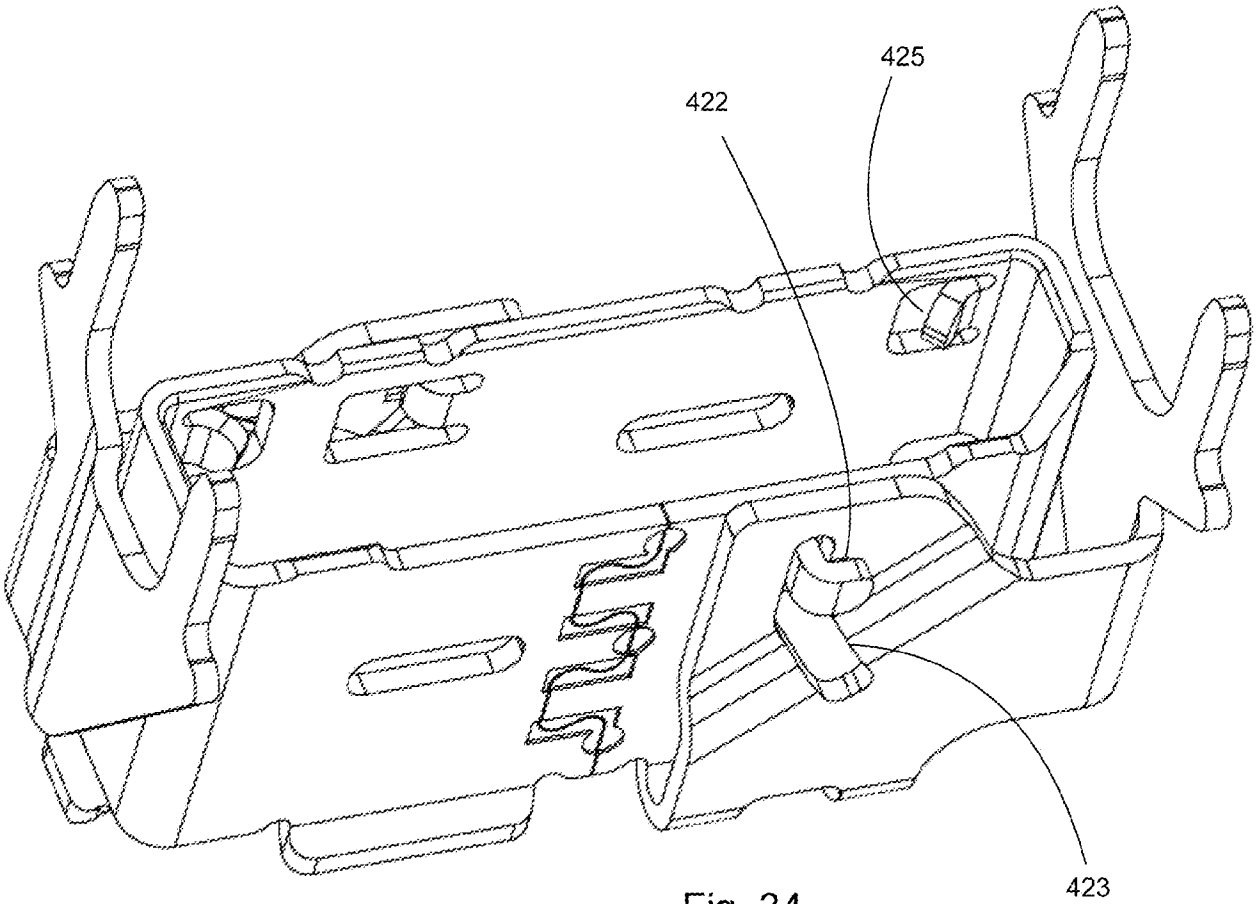
FIG. 34 illustrates another perspective view of the embodiment depicted in FIG. 33.

In an alternative embodiment, such as is depicted in FIGS. 33-34, tabs 422 can be formed in the body 403 and the tabs 422 extend through elongated slots 423 in the arms 410. The elongated slots 423 allow the arms 410 to be folded over the tab 422. The depicted tabs 422 are then folded over and help secure the arms 410 to the body 403 and provide additional structure rigidity without the need to weld the arm 410 to the body 403. Thus, there are different ways to support the arm 410 with the body 403 of the shield 402.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A plug connector assembly, comprising:

a shield having a body that defines an opening, the opening facing a first direction and the body having an outside surface;

at least one arm connected to the body, the at least one arm extending from the opening, the at least one arm having a distal end that includes at least one leg, the at least one leg configured to be soldered into a circuit board; and a connector positioned in the shield, the connector including a first wafer and a second wafer, each of the first and second wafers supporting a row of terminals, each of the terminals in the row including a contact and a tail on opposite ends of that terminal.

2. The plug connector assembly of claim 1, wherein the at least one arm extends from the body in the first direction and then extends away from the first direction via a folded section.

3. The plug connector assembly of claim 1, wherein the distal end of the at least one arm further includes at least one shoulder, the at least one shoulder configured to be adjacent a surface of the circuit board when the at least one leg is soldered into the circuit board.

4. The plug connector assembly of claim 1, wherein the at least one arm is attached to the outside surface of the body.

5. The plug connector assembly of claim 4, wherein the at least one arm includes a seam configured for use in attaching the at least one arm to the outside surface of the body.

6. The plug connector assembly of claim 4, wherein the at least one arm is welded to the outside surface of the body.

7. The plug connector assembly of claim 4, wherein the at least one arm is attached to the outside surface of the body via an adhesive material.

8. The plug connector assembly of claim 4, wherein the shield includes at least one tack weld configured for use in attaching the at least one arm to the outside surface of the body.

9. The plug connector assembly of claim 1, wherein the shield includes at least one lead-in feature adjacent the opening.

10. The plug connector assembly of claim 1, wherein the shield includes vents on a first and second side of the body, the vents configured to allow air to flow between the first and second sides of the body.

11. The plug connector assembly of claim 1, wherein the tails of the terminals are configured to be mated to the circuit board.

12. The plug connector assembly of claim 11, wherein the tails of the terminals being configured to be mated to the circuit board comprises the tails of the terminals being configured to be soldered to the circuit board.

13. The plug connector assembly of claim 1, further comprising a cable that extends from the plug connector assembly.

14. The plug connector assembly of claim 1, wherein the connector includes a support column that defines the relative position of the wafers with respect to each other, the support column extending between the wafers, the connector further including a housing shell positioned around the wafers, the housing shell defining a card slot, wherein the contacts are positioned in the card slot.

15. A plug connector assembly, comprising:

a shield having a body that defines an opening, the opening facing a first direction and the body having an outside surface;

at least one arm connected to the body, the at least one arm extending from the opening, the at least one arm having a distal end that includes at least one leg, the at least one leg configured to be soldered into a circuit board; and a connector positioned in the shield, the connector including a first wafer and a second wafer, each of the first and second wafers supporting a row of terminals, each of the terminals in the row including a contact and a tail on opposite ends of that terminal, wherein the at least one arm is attached to the outside surface of the body and wherein the body includes at least one tab and the at least one arm includes at least one slot configured for receiving the at least one tab for use in securing the at least one arm to the outside surface of the body.

* * * * *